US010909943B2

(12) United States Patent
Hu et al.

(10) Patent No.: US 10,909,943 B2
(45) Date of Patent: Feb. 2, 2021

(54) GATE DRIVE CIRCUIT AND DRIVING METHOD THEREOF, DISPLAY PANEL AND DISPLAY DEVICE

(71) Applicants: Beijing BOE Optoelectronics Technology Co., Ltd., Beijing (CN); BOE Technology Group Co., Ltd., Beijing (CN)

(72) Inventors: Guofeng Hu, Beijing (CN); Yankai Gao, Beijing (CN); Hong Liu, Beijing (CN); Yuxin Bi, Beijing (CN); Yanhui Xi, Beijing (CN); Bin Dai, Beijing (CN); Mingjian Yu, Beijing (CN); Hong Wang, Beijing (CN); Donghui Wang, Beijing (CN)

(73) Assignees: Beijing BOE Optoelectronics Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/549,229

(22) Filed: Aug. 23, 2019

(65) Prior Publication Data

US 2020/0251066 A1 Aug. 6, 2020

(30) Foreign Application Priority Data

Feb. 1, 2019 (CN) ..... 2019 1 0105407

(51) Int. Cl.
*G09G 3/36* (2006.01)

(52) U.S. Cl.
CPC ... *G09G 3/3677* (2013.01); *G09G 2300/0804* (2013.01); *G09G 2310/0286* (2013.01); *G09G 2310/08* (2013.01); *G09G 2320/0233* (2013.01)

(58) Field of Classification Search
CPC ..... G09G 3/3677; G09G 3/36; G09G 2310/0286; G09G 2310/0283; G09G 2310/0224; G09G 2310/0227; G11C 19/00
See application file for complete search history.

(56) References Cited

U.S. PATENT DOCUMENTS 9,437,325 B2 * 9/2016 Qian ..... G11C 19/184
9,916,803 B2 * 3/2018 Hohjoh ..... G09G 3/3614
(Continued)

FOREIGN PATENT DOCUMENTS

CN 104020873 A 9/2014
CN 106990868 A 7/2017
(Continued)

OTHER PUBLICATIONS

First office action of Chinese application No. 201810292162.5 dated Sep. 16, 2020.

*Primary Examiner* — Sardis F Azongha
(74) *Attorney, Agent, or Firm* — Fay Sharpe LLP

(57) ABSTRACT

Provided are a gate drive circuit and a driving method thereof, a display panel and a display device. The gate drive circuit includes a first sub-circuit group and a second sub-circuit group. The first sub-circuit group can drive the $m^{th}$ row to the first row of pixels of the N rows of pixels in the display panel row by row, and the second sub-circuit group can drive the $(m+1)^{th}$ row to the $N^{th}$ row of pixels row by row. In addition, m is greater than 1 and less than N.

14 Claims, 13 Drawing Sheets

(56) References Cited

U.S. PATENT DOCUMENTS

2001/0050662 A1* 12/2001 Kota ..... G09G 3/3216 345/76
2003/0043097 A1* 3/2003 Shingai ..... G09G 3/3666 345/87
2005/0078070 A1* 4/2005 An ..... G09G 3/3666 345/87
2007/0091059 A1* 4/2007 Kang ..... G09G 3/3648 345/102
2009/0256794 A1* 10/2009 Jang ..... G11C 19/28 345/100
2010/0201666 A1* 8/2010 Tobita ..... H01L 29/78666 345/208
2010/0231810 A1* 9/2010 Itoh ..... G09G 3/3677 348/731
2013/0009938 A1* 1/2013 Hwang ..... G09G 3/3644 345/212
2014/0085279 A1* 3/2014 Shiomi ..... G09G 3/3666 345/204
2014/0240246 A1 8/2014 Kim
2015/0109357 A1* 4/2015 Nakai ..... G09G 3/36 345/691
2015/0123959 A1* 5/2015 Yatabe ..... G02F 1/136286 345/209
2015/0243212 A1* 8/2015 Lee ..... G09G 3/3225 345/212
2016/0225311 A1* 8/2016 Hwang ..... G09G 3/3208
2018/0004341 A1 1/2018 Yeh et al.
2019/0095020 A1 3/2019 Wu et al.
2020/0033999 A1 1/2020 Xie et al.

FOREIGN PATENT DOCUMENTS

CN 107193442 A 9/2017
CN 107515697 A 12/2017
CN 107562249 A 1/2018
CN 107678588 A 2/2018

* cited by examiner

GATE DRIVE CIRCUIT AND DRIVING METHOD THEREOF, DISPLAY PANEL AND DISPLAY DEVICE

This application claims priority to Chinese Patent Application No. 201910105407.3, filed on Feb. 1, 2019 and entitled "GATE DRIVE CIRCUIT AND DRIVING METHOD THEREOF, DISPLAY PANEL AND DISPLAY DEVICE", the entire contents of which are incorporated herein by reference.

TECHNICAL FIELD

The present disclosure relates to the field of display technology, and particularly to a gate drive circuit and a driving method thereof, a display panel and a display device.

BACKGROUND

Liquid crystal display (LCD) devices are widely applied in the field of display for the advantages of its high resolution, lightness, low power consumption, and low radiation, etc. For example, the LCD devices may be applied in the field of virtual reality (VR).

A liquid crystal display device generally includes a liquid crystal display panel and a gate drive circuit. The liquid crystal display panel includes a plurality of rows of pixels, and each pixel includes a thin film transistor, a pixel electrode and a common electrode that are connected to the thin film transistor, and liquid crystal molecules between the pixel electrode and the common electrode. The gate drive circuit is connected to the thin film transistor in each pixel, and is configured to charge, via the thin film transistor, the pixel electrode connected to the thin film transistor, to drive the liquid crystal molecules to deflect. Currently, the gate drive circuit can drive the pixels row by row from the first row of pixels. That is, the gate drive circuit charges each pixel electrode row by row.

SUMMARY

The disclosure provides a gate drive circuit and a driving method thereof, a display panel and a display device. The technical solutions are as follows.

In an aspect, there is provided a gate drive circuit, configured to drive N rows of pixels included in a display panel, the gate drive circuit comprising: a first sub-circuit group and a second sub-circuit group; wherein the first sub-circuit group is connected to a first turn-on signal terminal, a first clock signal terminal and an $m^{th}$ row to a first row of pixels of the N rows of pixels, respectively, and configured to drive the $m^{th}$ row to the first row of pixels row by row in response to a first turn-on signal provided by the first turn-on signal terminal and a first clock signal provided by the first clock signal terminal; and the second sub-circuit group is connected to a second turn-on signal terminal, a second clock signal terminal, and an $(m+1)^{th}$ row to an $N^{th}$ row of pixels of the N rows of pixels, respectively, and configured to drive the $(m+1)^{th}$ row to the $N^{th}$ row of pixels row by row in response to a second turn-on signal provided by the second turn-on signal terminal and a second clock signal provided by the second clock signal terminal; wherein, N is an integer greater than 1, and m is an integer greater than 1 and less than N.

Optionally, the first sub-circuit group comprises: a first drive sub-circuit and a second drive sub-circuit; the first turn-on signal terminal comprises: a first turn-on sub-signal terminal and a second turn-on sub-signal terminal; and the first clock signal terminal comprises: a first clock sub-signal terminal and a second clock sub-signal terminal; wherein the first drive sub-circuit is connected to the first turn-on sub-signal terminal, the first clock sub-signal terminal and odd-number rows of pixels from the $m^{th}$ row to the first row of pixels, respectively, and configured to drive the odd-number rows of pixels from the $m^{th}$ row to the first row of pixels row by row in response to a first turn-on sub-signal provided by the first turn-on sub-signal terminal and a first clock sub-signal provided by the first clock sub-signal terminal; and the second drive sub-circuit is connected to the second turn-on sub-signal terminal, the second clock sub-signal terminal, and even-number rows of pixels from the $m^{th}$ row to the first row of pixels, respectively, and configured to drive the even-number rows of pixels from the $m^{th}$ row to the first row of pixels row by row in response to a second turn-on sub-signal provided by the second turn-on sub-signal terminal and a second clock sub-signal provided by the second clock sub-signal terminal.

Optionally, the first drive sub-circuit and the second drive sub-circuit both comprise at least two cascaded shift register units, and each shift register unit is connected to one row of pixels; and the first sub-circuit group further comprises: two first dummy sub-circuits and two second dummy sub-circuits; wherein each of the first dummy sub-circuits is connected to the first turn-on sub-signal terminal and the first clock sub-signal terminal respectively, one of the first dummy sub-circuits is connected to an input terminal of a first stage of shift register unit in the first drive sub-circuit and configured to transmit the first turn-on sub-signal to the first stage of shift register unit in the first drive sub-circuit under the drive of the first turn-on sub-signal and the first clock sub-signal; and the other one of the first dummy sub-circuits is connected to an input terminal of a last stage of shift register unit in the first drive sub-circuit and configured to transmit the first turn-on sub-signal to the last stage of shift register unit in the first drive sub-circuit under the drive of the first turn-on sub-signal and the first clock sub-signal; and each of the second dummy sub-circuits is connected to the second turn-on sub-signal terminal and the second clock sub-signal terminal respectively, one of the second dummy sub-circuits is connected to an input terminal of a first stage of shift register unit in the second drive sub-circuit and configured to transmit the second turn-on sub-signal to the first stage of shift register unit in the second drive sub-circuit under the drive of the second turn-on sub-signal and the second clock sub-signal; and the other one of the second dummy sub-circuits is connected to an input terminal of a last stage of shift register unit in the second drive sub-circuit and configured to transmit the second turn-on sub-signal to the last stage of shift register unit in the second drive sub-circuit under the drive of the second turn-on sub-signal and the second clock sub-signal.

Optionally, the second sub-circuit group further comprises: a third drive sub-circuit and a fourth drive sub-circuit; the second turn-on signal terminal comprises: a third turn-on sub-signal terminal and a fourth turn-on sub-signal terminal; and the second clock signal terminal comprises: a third clock sub-signal terminal and a fourth clock sub-signal terminal; wherein the third drive sub-circuit is connected to the third turn-on sub-signal terminal, the third clock sub-signal terminal, and odd-number rows of pixels from the $(m+1)^{th}$ row to the $N^{th}$ row of pixels, respectively, and configured to drive the odd-number rows of pixels from the $(m+1)^{th}$ row to the $N^{th}$ row of pixels row by row in response to a third turn-on sub-signal provided by the third turn-on sub-signal terminal and a third clock sub-signal provided by the third clock sub-signal terminal; and the fourth drive sub-circuit is connected to the fourth turn-on sub-signal terminal, the fourth clock sub-signal terminal and even-number rows of pixels from the $(m+1)^{th}$ row to the $N^{th}$ row of pixels, respectively, and configured to drive the even-number rows of pixels from the $(m+1)^{th}$ row to the $N^{th}$ row of pixels row by row in response to a fourth turn-on sub-signal provided by the fourth turn-on sub-signal terminal and a fourth clock sub-signal provided by the fourth clock sub-signal terminal.

Optionally, the third drive sub-circuit and the fourth drive sub-circuit both comprise at least two cascaded shift register units, and each shift register unit is connected to one row of pixels; and the second sub-circuit group further comprises: two third dummy sub-circuits and two fourth dummy sub-circuits; wherein each of the third dummy sub-circuits is connected to the third turn-on sub-signal terminal and the third clock sub-signal terminal respectively, one of the third dummy sub-circuits is connected to an input terminal of a first stage of shift register unit in the third drive sub-circuit and configured to transmit the third turn-on sub-signal to the first stage of shift register unit in the third drive sub-circuit under the drive of the third turn-on sub-signal and the third clock sub-signal; and the other one of the third dummy sub-circuits is connected to an input terminal of a last stage of shift register unit in the third drive sub-circuit and configured to transmit the third turn-on sub-signal to the last stage of shift register unit in the third drive sub-circuit under the drive of the third turn-on sub-signal and the third clock sub-signal; and each of the fourth dummy sub-circuits is connected to the fourth turn-on sub-signal terminal and the fourth clock sub-signal terminal respectively, one of the fourth dummy sub-circuits is connected to an input terminal of a first stage of shift register unit in the fourth drive sub-circuit and configured to transmit the fourth turn-on sub-signal to the first stage of shift register unit in the fourth drive sub-circuit under the drive of the fourth turn-on sub-signal and the fourth clock sub-signal; and the other one of the fourth dummy sub-circuits is connected to an input terminal of a last stage of shift register unit in the fourth drive sub-circuit and configured to transmit the fourth turn-on sub-signal to the last stage of shift register unit in the fourth drive sub-circuit under the drive of the fourth turn-on sub-signal and the fourth clock sub-signal.

Optionally, the first sub-circuit group comprises a first drive sub-circuit and a second drive sub-circuit; wherein the first drive sub-circuit and the second drive sub-circuit are disposed oppositely on the two sides of the display panel, and the third drive sub-circuit and the fourth drive sub-circuit are disposed oppositely on the two sides of the display panel; wherein the first drive sub-circuit and the third drive sub-circuit are on the same side of the display panel, and the second drive sub-circuit and the fourth drive sub-circuit are on the same side of the display panel, and both an extending direction of a side edge of the side which the first drive sub-circuit and the third drive sub-circuit are on and an extending direction of a side edge of the side which the second drive sub-circuit and the fourth drive sub-circuit are on are perpendicular to an extending direction of a gate line in the display panel.

Optionally, N is an even number and m satisfies: $m=N/2$. Alternatively, N is an odd number, m satisfies: $m=\lceil N/2 \rceil$ or $m=\lfloor N/2 \rfloor$; wherein $\lceil\ \rceil$ represents rounding up to the nearest integer and $\lfloor\ \rfloor$ represents rounding down to the nearest integer.

In another aspect, there is provided a display panel, comprising: N rows of pixels and the above-described gate drive circuit connected to the N rows of pixels.

In yet another aspect, there is provided a display device, comprising: the display panel described in the above aspect.

Optionally, the display device further comprises: a first control circuit and a second control circuit; wherein the first control circuit is connected the first turn-on signal terminal and the first clock signal terminal, respectively, and configured to provide signals to the first turn-on signal terminal and the first clock signal terminal; and the second control circuit is connected the second turn-on signal terminal and the second clock signal terminal, respectively, and configured to provide signals to the second turn-on signal terminal and the second clock signal terminal.

Optionally, the first control circuit and the second control circuit are disposed oppositely on the two sides of the display panel; and both an extending direction of a side edge of the side which the first control circuit is on and an extending direction of a side edge of the side which the second control circuit is on are parallel to an extending direction of a gate line in the display panel.

In still yet another aspect, there is provided a method for driving a gate drive circuit. The method is applied to the gate drive circuit described in the above aspect. The method comprises: in a first drive stage during which a first turn-on signal provided by a first turn-on signal terminal and a first clock signal provided by the first clock signal terminal are both at a first potential, driving, by a first sub-circuit group, an $m^{th}$ row to a first row of pixels of an N rows of pixels included in the display panel row by row in response to the first turn-on signal and the first clock signal; and in a second drive stage during which a second turn-on signal provided by a second turn-on signal terminal and a second clock signal provided by the second clock signal terminal are both at a first potential, driving, by a second sub-circuit group, an $(m+1)^{th}$ row to the $N^{th}$ row of pixels of the N rows of pixels row by row in response to the second turn-on signal and the second clock signal; wherein a time duration between a moment when the first turn-on signal is at the first potential and a moment when the second turn-on signal is at the first potential is less than a clock cycle of a clock signal, N is an integer greater than 1, and m is an integer greater than 1 and less than N.

Optionally, the first sub-circuit group comprise: a first drive sub-circuit and a second drive sub-circuit; the first turn-on signal terminal comprises: a first turn-on sub-signal terminal and a second turn-on sub-signal terminal; the first clock signal terminal comprises: a first clock sub-signal terminal and a second clock sub-signal terminal; and the first drive stage comprises: a first sub-stage during which a first turn-on sub-signal provided by the first turn-on sub-signal terminal and a first clock sub-signal provided by the first clock sub-signal terminal are both at a first potential, driving, by the first drive sub-circuit, odd-number rows of pixels of the $m^{th}$ row to the first row of pixels row by row in response to the first turn-on sub-signal and the first clock sub-signal; and in a second sub-stage during which a second turn-on sub-signal provided by the second turn-on sub-signal terminal and a second clock sub-signal provided by the second clock sub-signal terminal are both at a first potential, driving, by the second drive sub-circuit, even-number rows of pixels from the $m^{th}$ row to the first row of pixels row by row in response to the second turn-on sub-signal and the second clock sub-signal.

Optionally, the second sub-circuit group comprise: a third drive sub-circuit and a fourth drive sub-circuit; the second turn-on signal terminal comprises: a third turn-on sub-signal terminal and a fourth turn-on sub-signal terminal; the second clock signal terminal comprises: a third clock sub-signal terminal and a fourth clock sub-signal terminal; and the second drive stage comprises: a third sub-stage during which a third turn-on sub-signal provided by the third turn-on sub-signal terminal and a third clock sub-signal provided by the third clock sub-signal terminal are both at a first potential, driving, by the third drive sub-circuit, odd-number rows of pixels of the $(m+1)^{th}$ row to the $N^{th}$ row of pixels row by row in response to the third turn-on sub-signal and the third clock sub-signal; and in a fourth sub-stage during which a fourth turn-on sub-signal provided by the fourth turn-on sub-signal terminal and a fourth clock sub-signal provided by the fourth clock sub-signal terminal are both at a first potential, driving, by the fourth drive sub-circuit, even-number rows of pixels from the $(m+1)^{th}$ row to the $N^{th}$ row of pixels row by row in response to the fourth turn-on sub-signal and the fourth clock sub-signal.

Optionally, the first turn-on signal terminal comprises: a first turn-on sub-signal terminal and a second turn-on sub-signal terminal; and the first clock signal terminal comprises: a first clock sub-signal terminal and a second clock sub-signal terminal; wherein the third turn-on sub-signal, the fourth turn-on sub-signal, a first turn-on sub-signal provided by the first turn-on sub-signal terminal, and a second turn-on sub-signal provided by the second turn-on sub-signal terminal are at a first potential sequentially, when the third turn-on sub-signal is at the first potential, the third clock sub-signal is at the first potential; when the fourth turn-on sub-signal is at the first potential, the fourth clock sub-signal is at the first potential; when the first turn-on sub-signal is at the first potential, a first clock sub-signal provided by the first clock sub-signal terminal is at the first potential, and when the second turn-on sub-signal is at the first potential, a second clock sub-signal provided by the second clock sub-signal terminal is at the first potential; wherein the third clock sub-signal, the fourth clock sub-signal, the first clock sub-signal, and the second clock sub-signal have the same clock cycle and the same duty ratio of 1/4, and in each clock cycle, the third clock sub-signal, the fourth clock sub-signal, the first clock sub-signal and the second clock sub-signal are at the first potential sequentially.

Optionally, prior to the first drive stage and the second drive stage, the method further comprises: in a dummy output stage during which the first turn-on signal provided by the first turn-on signal terminal and the second turn-on signal provided by the second turn-on signal terminal are both at a second potential, the first clock signal terminal provides a first clock signal, and the second clock signal terminal provides a second clock signal.

BRIEF DESCRIPTION OF THE DRAWINGS

In order to describe the technical solutions in the embodiments of the present more clearly, the following briefly introduces the accompanying drawings required for describing the embodiments. Apparently, the accompanying drawings in the following description show merely some embodiments of the present disclosure, and a person of ordinary skill in the art may also derive other drawings from these accompanying drawings without creative efforts.

DETAILED DESCRIPTION

The embodiments of the present disclosure will be described in detail below with reference to the accompanying drawings to present the objectives, technical solutions, and advantages of the present disclosure more clearly.

With the development of display technology, a series of different types of display devices, such as organic light emitting diode (OLED) display devices and LCD display devices, appears in the market currently. However, due to the limit of the process conditions, the resolution of the display devices is generally relatively low. When the resolution is relatively low, the screen door effect (that is, a user's eyes may directly observe pixels in the display panel, which is similar to the case of viewing images through a screen window) may occur on the display device. Therefore, in order to avoid the screen door effect, LCD display devices are widely applied in the display field (for example, VR field).

In the related art, in order to charge pixel electrodes in N rows of pixels included in the LCD panel, the gate drive circuit in the LCD display device generally includes N cascaded shift register units, and each stage of shift register unit may be connected to one row of pixels. When the LCD panel is driven to display an image, the N cascaded shift register units may be turned on stage by stage from the first stage of shift register unit, such that the N rows of pixels may be driven from the first row of pixels in the display panel. Alternatively, the N cascaded shift register units may be turned on stage by stage from the last stage of shift register unit, such that the N rows of pixels may be driven from the last row of pixels in the display panel.

However, as the response time of liquid crystal molecules is relatively long, liquid crystal molecules in some rows of pixels at the headend or tail end of the LCD panel may not be able to deflect to the designated state, resulting in generation of ghosting phenomenon (that is, black horizontal stripes exist on the images displayed by the display panel) on the images displayed by the LCD panel. When the refresh rate of the LCD panel is relatively high (that is, the number of times the screen is refreshed per second is relatively large), the gate drive circuit drives the N rows of pixels quickly, which may result in that liquid crystal molecules in part of the middle region in the LCD panel may not be able to deflect to the designated state, such that the ghosting phenomenon occurs. That is, the display effect in part of the middle region in the LCD panel is poor. As for the VR field, as users generally focus on viewing the middle region of the display panel, the ghosting phenomenon also affects the display effect seriously, which results in poor user experience.

Figure 1:
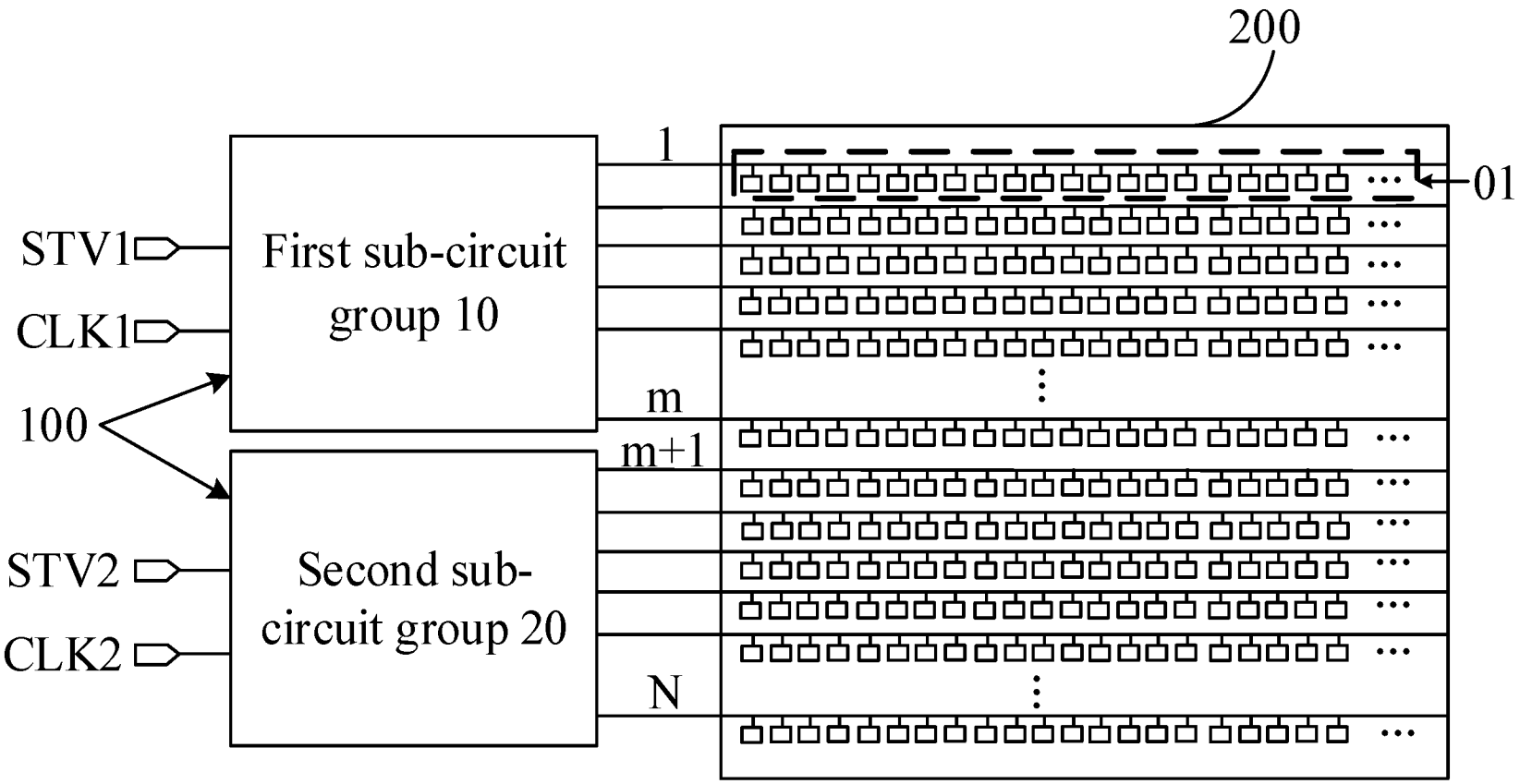
FIG. 1 is a schematic diagram of a structure of a gate drive circuit applied in a display panel according to an embodiment of the present disclosure.

An embodiment of the present disclosure provides a gate drive circuit, which can solve the problem of poor display effect at least in the middle region of the display panel caused by the ghosting phenomenon under the premise of solving the screen door effect. FIG. 1 is a schematic diagram of a structure of a gate drive circuit according to an embodiment of the present disclosure. The gate drive circuit 100 may be applied in a drive display panel (for example, a liquid crystal display panel) 200. As shown in FIG. 1, the display panel 200 may include N rows of pixels 01. The gate drive circuit 100 may include: a first sub-circuit group 10 and a second sub-circuit group 20.

Referring to FIG. 1, the first sub-circuit group 10 may be connected to a first turn-on signal terminal STV1, a first clock signal terminal CLK1, and the $m^{th}$ row to the first row of pixels of the N rows of pixels, respectively. The first sub-circuit group 10 may be configured to drive the $m^{th}$ row to the first row of pixels row by row in response to a first turn-on signal provided by the first turn-on signal terminal STV1 and a first clock signal provided by the first clock signal terminal CLK1.

Exemplarily, the first sub-circuit group 10 may be turned on when the first turn-on signal is at a first potential, and may output the first clock signals to the $m^{th}$ row to the first row of pixels row by row. That is, the first sub-circuit group 10 may drive the $m^{th}$ row to the first row of pixels row by row. In the embodiments of the present disclosure, the first potential may be an effective potential.

Referring to FIG. 1, the second sub-circuit group 20 may be connected to a second turn-on signal terminal STV2, a second clock signal terminal CLK2, and the $(m+1)^{th}$ row to the $N^{th}$ row of pixels of the N rows of pixels, respectively. The second sub-circuit group 20 may be configured to drive the $(m+1)^{th}$ row to the $N^{th}$ row of pixels row by row in response to a second turn-on signal provided by the second turn-on signal terminal STV2 and a second clock signal provided by the second clock signal terminal CLK2.

Exemplarily, the second sub-circuit group 20 may be turned on when the second turn-on signal is at the first potential, and may output the second clock signals to the $(m+1)^{th}$ row to the $N^{th}$ row of pixels row by row. That is, the second sub-circuit group 20 may drive the $(m+1)^{th}$ row to the $N^{th}$ row of pixels row by row.

Here, N may be an integer greater than 1, and m may be an integer greater than 1 and less than N. That is, the first sub-circuit group 10 may drive the $m^{th}$ row to the first row of pixels row by row on one side from a middle row of pixels in the display panel. That is, the first sub-circuit group 10 may drive the first m rows of pixels of the N rows of pixels row. The second sub-circuit group 20 may drive the $(m+1)^{th}$ row to the $N^{th}$ row of pixels row by row on the other side from a middle row of pixels. That is, the second sub-circuit group 20 may drive the last N−m rows of pixels of the N rows of pixels row by row.

In the embodiments of the present disclosure, the time duration between the moment when the first turn-on signal is at the first potential and the moment when the second turn-on signal is at the first potential may be shorter than the clock cycle of a clock signal. Correspondingly, the first sub-circuit group 10 and the second sub-circuit group 20 may alternately drive the pixels sequentially from a row of pixels in the middle of the display panel to the two sides. That is, when the first sub-circuit group 10 finishes driving a row of pixel of the first m rows of pixels, in one clock cycle, the second sub-circuit group 20 may start driving a row of pixels in the last N-m rows of pixels. That is, the first sub-circuit group 10 and the second sub-circuit group 20 may alternately drive the pixels in each clock cycle. Here, the moment when the turn-on clock signal is at the first potential may refer to the moment when the turn-on signal hops to the first potential from a second potential.

When the first turn-on signal and the second turn-on signal have different timings, the driving sequences of the gate drive circuit may be different. Optionally, in the first sub-circuit group 10 and the second sub-circuit group 20, one sub-circuit group may drive one row of pixels first, and then the other sub-circuit group may drive one row of pixels, and the like. Alternatively, one sub-circuit group may drive two rows of pixels row by row first, and then the other sub-circuit group may drive two rows of pixels row by row, and the like. Alternatively, one sub-circuit group may drive one row of pixels first, and then the other sub-circuit group may drive two rows of pixels row by row, and the like. Alternatively, one sub-circuit group may drive two rows of pixels row by row first, and then the other sub-circuit group may drive one row of pixels, and the like. The driving method is not limited in the embodiments of the present disclosure.

Optionally, in the embodiments of the present disclosure, the time duration for driving the first m rows of pixels by the first sub-circuit group 10 may be equal or close to the time duration for driving the last N-m rows of pixels by the second sub-circuit group 20. For example, the difference between the two time durations may be less than one clock cycle.

By driving the pixels row by row sequentially and alternatively from a middle row of pixels in the display panel, the region in which the response time of the liquid crystal molecules is insufficient may disperse to the edge regions at the two sides of the display panel, which ensures that the liquid crystal molecules in the middle region can deflect to the designated state, thereby ensuring that no ghosting phenomenon occurs in the middle region of the display panel. When the gate drive circuit is applied in the VR field, users' viewing experience can be effectively improved when the VR head-mounted display device is used.

In summary, the embodiments of the present disclosure provide a gate drive circuit. The gate drive circuit includes a first sub-circuit group and a second sub-circuit group. The first sub-circuit group can drive the $m^{th}$ row to the first row of pixels of the N rows of pixels in the display panel row by row and the second sub-circuit group can drive the $(m+1)^{th}$ row to the $N^{th}$ row of pixels row by row. Thus, the gate drive circuit can drive the pixels row by row sequentially from a middle row of pixels to the two sides in the display panel, such that the liquid crystal molecules in the middle region of the display panel can deflect to the designated state, to disperse the regions where the ghosting phenomenon may occur to the edge regions at the two sides of the display panel, thereby ensuring that no ghosting phenomenon occurs in the middle region of the display panel, and improving the display effect.

Optionally, in the embodiments of the present disclosure, when N is an even number, m may satisfy: m=N/2. Correspondingly, the first sub-circuit group 10 may be connected to from the $N/2^{th}$ row to the first row of pixels (i.e., the first N/2 rows of pixels) of the N rows of pixels included in the display panel, and the second sub-circuit group 20 may be connected to from the $(N/2+1)^{th}$ row to the $N^{th}$ rows of pixels (i.e., the last N/2 rows of pixels).

Exemplarily, when N is 1280, m is 640. Correspondingly, the first sub-circuit group 10 may be connected to from the $640^{th}$ row to the first row of pixels (i.e., the first 640 rows of pixels), and may drive the $640^{th}$ row to the first row of pixels row by row starting from the $640^{th}$ row of pixels. The second sub-circuit group 20 may be connected to from the $641^{th}$ row to the $1280^{th}$ rows of pixels (i.e., the last $640^{th}$ row of pixels), and may drive the $641^{th}$ row to the $1280^{th}$ rows of pixels row by row starting from the $641^{th}$ row of pixels.

Optionally, in the embodiments of the present disclosure, when N is an odd number, m may satisfy: $m=\lceil N/2 \rceil$ or $m=\lfloor N/2 \rfloor$. $\lceil\ \rceil$ represents rounding up to the nearest integer, and $\lfloor\ \rfloor$ represents rounding down to the nearest integer. Correspondingly, when m satisfies: $m=\lceil N/2 \rceil$, the first sub-circuit group 10 may be connected to from the $\lceil N/2 \rceil^{th}$ row to the first row of pixels of the N rows of pixels, and the second sub-circuit group 20 may be connected to from the $(\lceil N/2 \rceil+1)^{th}$ row to the $N^{th}$ row of pixels of the N rows of pixels. When m satisfies: $m=\lfloor N/2 \rfloor$, the first sub-circuit group 10 may be connected to from the $\lfloor N/2 \rfloor^{th}$ row to the first row of pixels of the N rows of pixels, and the second sub-circuit group 20 may be connected to from the $(\lfloor N/2 \rfloor+1)^{th}$ row to the $N^{th}$ row of pixels of the N rows of pixels.

Exemplarily, assuming that N is 1281 and m satisfies: $m=\lceil N/2 \rceil$, then m is 641. Correspondingly, the first sub-circuit group 10 may be connected to from the $641^{th}$ row to the first row of pixels, and drive the $641^{th}$ row to the first row of pixels row by row starting from the $641^{th}$ row of pixels. The second sub-circuit group 20 may be connected to from the $642^{th}$ row to the $1281^{th}$ row of pixels and drive the $642^{th}$ row to the $1281^{th}$ row of pixels row by row starting from the $642^{th}$ row of pixels.

Assuming that N is 1281 and m satisfies: $m=\lfloor N/2 \rfloor$, then m is 640. The first sub-circuit group 10 may be connected to from the $640^{th}$ row to the first row of pixels, and drive the $640^{th}$ row to the first row of pixels row by row starting from the $640^{th}$ row of pixels. The second sub-circuit group 20 may be connected to from the $641^{th}$ row to the $1281^{th}$ row of pixels and drive the $641^{th}$ row to the $1281^{th}$ row of pixels row by row starting from the $641^{th}$ row of pixels.

By setting m to satisfy: m=N/2 when N is an even number and setting m to satisfy: $m=\lceil N/2 \rceil$ or $\lfloor N/2 \rfloor$ when N is an odd number, the gate drive circuit can be enabled to drive pixels row by row from a row of pixels in the very middle of the display panel to the two sides. Thus, it further ensures that the liquid crystal molecules in the middle region can deflect to the designated state, and ensures that no ghosting phenomenon occurs in the middle region of the display panel, which further improves user experience for the VR field.

Figure 2:
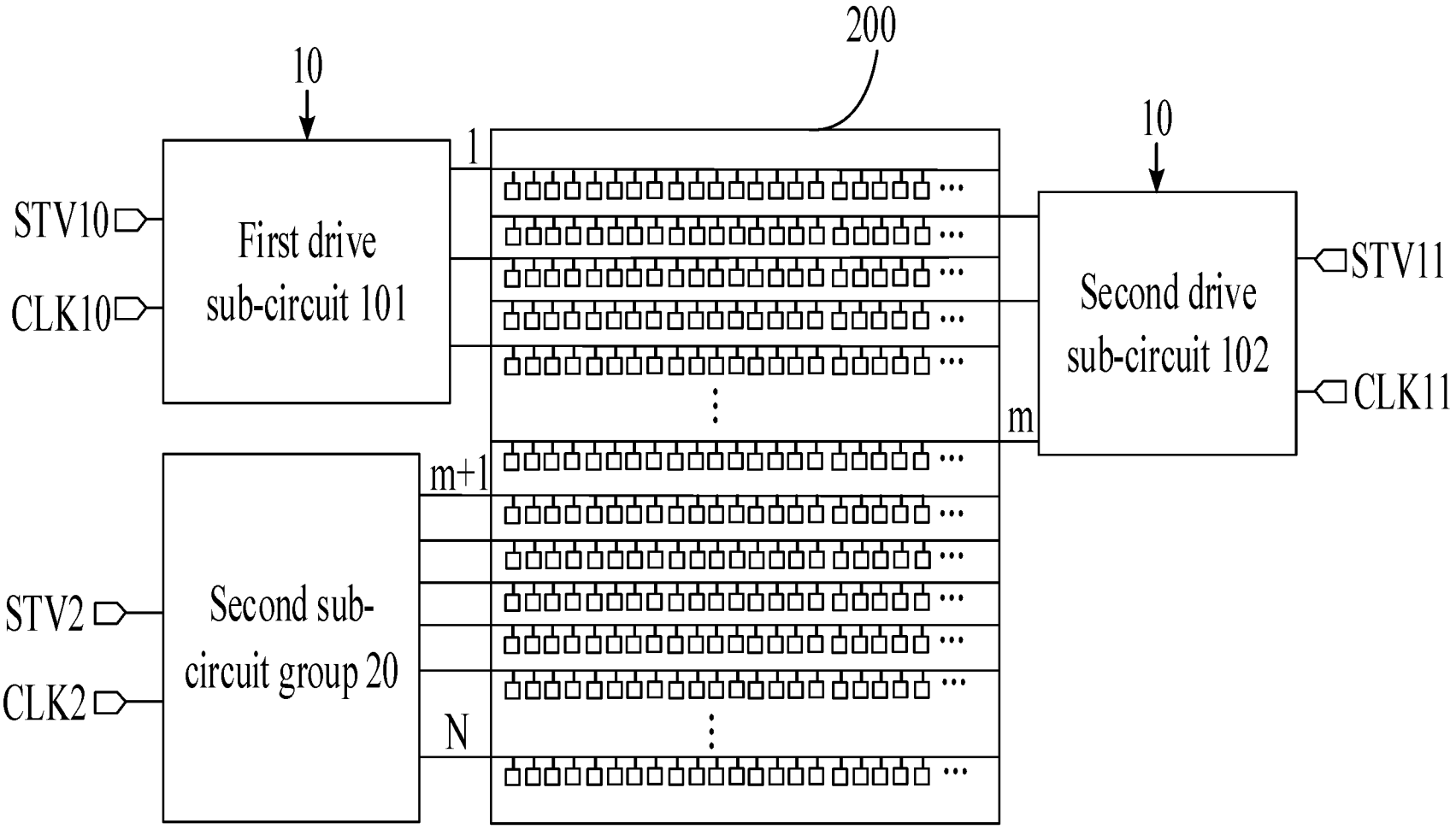
FIG. 2 is a schematic diagram of a structure of another gate drive circuit applied in a display panel according to an embodiment of the present disclosure.

FIG. 2 is a schematic diagram of a structure of another gate drive circuit applied in a display panel according to an embodiment of the present disclosure. As shown in FIG. 2, the first sub-circuit group 10 may include: a first drive sub-circuit 101 and a second drive sub-circuit 102.

The first turn-on signal terminal STV1 includes: a first turn-on sub-signal terminal STV10 and a second turn-on sub-signal terminal STV11, and the first clock signal terminal CLK1 may include: a first clock sub-signal terminal CLK10 and a second clock sub-signal terminal CLK11.

Referring to FIG. 2, the first drive sub-circuit 101 may be connected to from the first turn-on sub-signal terminal STV10, the first clock sub-signal terminal CLK10 and odd-number rows of pixels from the $m^{th}$ row to the first row of pixels, respectively. The first drive sub-circuit 101 may be configured to drive the odd-number rows of pixels from the $m^{th}$ row to the first row of pixels row by row in response to a first turn-on sub-signal provided by the first turn-on sub-signal terminal STV10 and a first clock sub-signal provided by the first clock sub-signal terminal CLK10.

Here, the first drive sub-circuit 101 may include a plurality of cascaded shift register units. The shift register unit may also be referred to as a gate driver on array (GOA) unit. The input terminal of the first stage of GOA unit or the last stage of GOA unit of the plurality of cascaded GOA units may be connected to the first turn-on sub-signal terminal STV10. The first stage of GOA unit or the last stage of GOA unit connected to the first turn-on sub-signal terminal STV10 may be turned on when the first turn-on sub-signal provided by the first turn-on sub-signal terminal STV10 is at the first potential, to drive one row of pixels connected thereto and drive other stages of GOA units to turn on stage by stage.

Exemplarily, assuming that N is 1280 and m satisfies: m=N/2, then m is 640. The first drive sub-circuit 101 may be connected to the odd-number rows of pixels from the $640^{th}$ row to the first row of pixels. The first drive sub-circuit 101 may be turned on when the first turn-on sub-signal is at the first potential and can output the first clock sub-signal to the odd-number rows of pixels from the $640^{th}$ row to the first row of pixels row by row. That is, the first drive sub-circuit 101 may drive the odd-number rows of pixels from the $640^{th}$ row to the first row of pixels row by row.

Referring to FIG. 2, the second drive sub-circuit 102 may be connected to the second turn-on sub-signal terminal STV11, the second clock sub-signal terminal CLK11 and even-number rows of pixels from the $m^{th}$ row to the first row of pixels, respectively. The second drive sub-circuit 102 may be configured to drive the even-number rows of pixels from the $m^{th}$ row to the first row of pixels row by row in response to a second turn-on sub-signal provided by the second turn-on sub-signal terminal STV11 and a second clock sub-signal provided by the second clock sub-signal terminal CLK11.

Here, the second drive sub-circuit 102 may include a plurality of cascaded GOA units. The input terminal of the first stage of GOA unit or the last stage of GOA unit may be connected to the second turn-on sub-signal terminal STV11. The first stage of GOA unit or the last stage of GOA unit connected to the second turn-on sub-signal terminal STV11 may be turned on when the second turn-on sub-signal provided by the second turn-on sub-signal terminal STV11 is at the first potential, to drive one row of pixels connected thereto and drive other stages of GOA units to turn on stage by stage.

Exemplarily, assuming that m is 640, then the second drive sub-circuit 102 may be connected to the even-number rows of pixels from the $640^{th}$ row to the first row of pixels. The second drive sub-circuit 102 may be turned on when the second turn-on sub-signal is at the first potential and can output the second clock sub-signal to the even-number rows of pixels from the $640^{th}$ row to the first row of pixels row by row. That is, the second drive sub-circuit 102 may drive the even-number rows of pixels from the $640^{th}$ row to the first row of pixels row by row.

In the embodiments of the present disclosure, the clock cycle and the duty ratio of the first clock sub-signal may be the same as those of the second clock sub-signal. For example, the duty ratios may both be 1/4. In addition, the time duration between the moment when the first turn-on sub-signal is at the first potential and the moment when the second turn-on sub-signal is at the first potential may be shorter than the clock cycle. Here, the moment when each turn-on sub-signal is at the first potential may refer to a moment when the potential of the turn-on sub-signal hops from the second potential to the first potential.

Correspondingly, the first drive sub-circuit 101 and the second drive sub-circuit 102 may alternately drive the first m rows of pixels row by row. That is, when the first drive circuit 101 finishes driving an odd-number row of pixels from the first m rows of pixels, in one clock cycle, the second drive sub-circuit 102 may start driving an even-number row of pixels that is adjacent to and after the odd-number row of pixels. That is, in each clock cycle, the first drive sub-circuit 101 and the second drive sub-circuit 102 may sequentially drive the first m rows of pixels. In addition, in each clock cycle, after the second drive sub-circuit 102 finishes driving the even-number row of pixels, the second sub-circuit group 20 may start driving one or two rows of pixels of the last N-m rows of pixels.

Exemplarily, it is assumed that m is an even number, and the first turn-on sub-signal, the second turn-on sub-signal, and the second turn-on signal are at the first potential sequentially in one clock cycle. The first drive sub-circuit 101 may be turned on first and drive the $(m-1)^{th}$ row of pixels of the first m rows of pixels. Then, when the first drive sub-circuit 101 finishes driving the $(m-1)^{th}$ row of pixels, the second drive sub-circuit 102 may be turned on and drive the $m^{th}$ row of pixels. When the second drive sub-circuit 102 finishes driving the $m^{th}$ row of pixels, the second sub-circuit group 20 may be turned on and start driving one or two rows of pixels of the last N-m rows of pixels. Thereafter, the plurality of stages of GOA units in each drive sub-circuit may be turned on sequentially stage by stage, and drive the N rows of pixels in accordance with the driving sequence of the first drive sub-circuit 101, the second drive sub-circuit 102, and the second sub-circuit group 20.

By disposing the first drive sub-circuit 101 and the second drive sub-circuit 102, the first sub-circuit group 10 can drive the odd-number rows of pixels and the even-number rows of pixels of the first m rows of pixels sequentially in one clock cycle, which can further ensure that the liquid crystal molecules in the pixels in the middle region of the first m rows of pixels can deflect to the designated state, thereby ensuring the display effect in the middle region and also enriching the driving method of the gate drive circuit.

Optionally, when timing of the first turn-on sub-signal, the second turn-on sub-signal, and the second turn-on signal change, the turn-on sequence of the first drive sub-circuit 101, the second drive sub-circuit 102, and the second sub-circuit group 20 change. Correspondingly, the sequence for driving the pixels by the gate drive circuit also changes.

Figure 3:
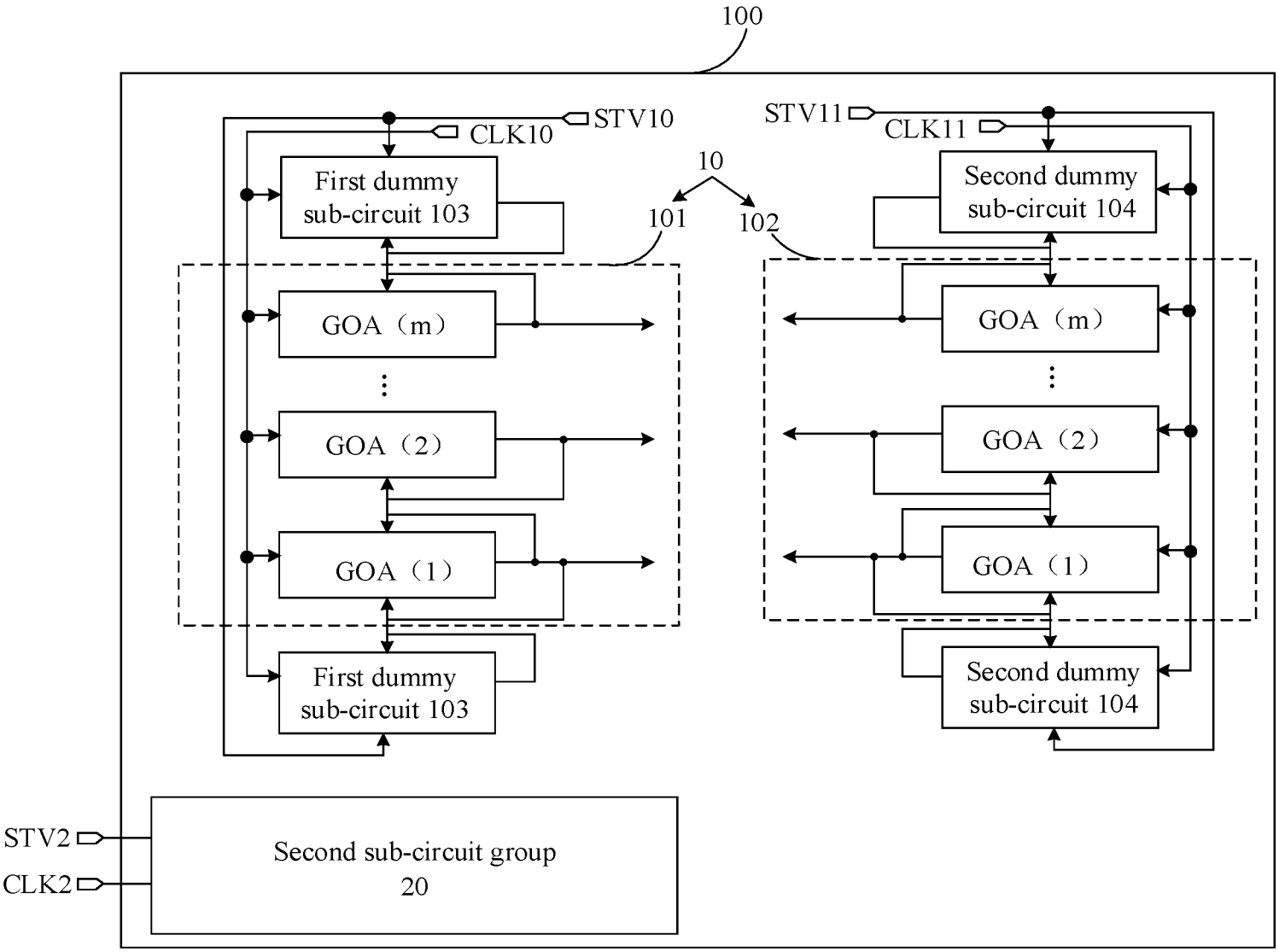
FIG. 3 is a schematic diagram of a structure of then another gate drive circuit according to an embodiment of the present disclosure.

FIG. 3 is a schematic diagram of a structure of then another gate drive circuit according to an embodiment of the present disclosure. As shown in FIG. 3, the first drive sub-circuit 101 and the second drive sub-circuit 102 may both include at least two cascaded GOA units. Each stage of shift register unit may be connected to one row of pixels (not shown in FIG. 3). Optionally, referring to FIG. 3, the first sub-circuit group 10 may further include: two first dummy sub-circuits 103 and two second dummy sub-circuits 104. The first dummy sub-circuits 103 and the second dummy sub-circuits 104 may also be referred to as dummy shift register units, i.e., dummy GOA units.

Each of the first dummy sub-circuits 103 may be connected to the first turn-on sub-signal terminal STV10 and the first clock sub-signal terminal CLK10 respectively. One of the first dummy sub-circuits 103 may further be connected to an input terminal of the first stage of shift register unit GOA (1) in the first drive sub-circuit 101 and configured to transmit the first turn-on sub-signal to the first stage of shift register unit GOA (1) in the first drive sub-circuit 101 under the drive of the first turn-on sub-signal and the first clock sub-signal. The other one of the first dummy sub-circuits 103 may further be connected to an input terminal of the last stage of shift register unit GOA (m) in the first drive sub-circuit 101 and configured to transmit the first turn-on sub-signal to the last stage of shift register unit GOA (m) in the first drive sub-circuit 101 under the drive of the first turn-on sub-signal and the first clock sub-signal.

Exemplarily, the first dummy sub-circuit 103 connected to the first stage of shift register unit GOA (1) may be turned on when the first turn-on sub-signal is at the first potential and transmit the first turn-on sub-signal to the first stage of shift register unit GOA (1). Alternatively, the first dummy sub-circuit 103 connected to the last stage of shift register unit GOA (m) may be turned on when the first turn-on sub-signal is at the first potential and transmit the first turn-on sub-signal to the last stage of shift register unit GOA (m).

Each of the second dummy sub-circuits 104 may be connected to the second turn-on sub-signal terminal STV11 and the second clock sub-signal terminal CLK11 respectively. One of the second dummy sub-circuits 104 may be connected to an input terminal of the first stage of shift register unit GOA (1) in the second drive sub-circuit 102 and configured to transmit the second turn-on sub-signal to the first stage of shift register unit GOA (1) in the second drive sub-circuit 102 under the drive of the second turn-on sub-signal and the second clock sub-signal. The other one of the second dummy sub-circuits 104 may be connected to an input terminal of the last stage of shift register unit GOA (m) in the second drive sub-circuit 102 and configured to transmit the second turn-on sub-signal to the last stage of shift register unit GOA (m) in the second drive sub-circuit 102 under the drive of the second turn-on sub-signal and the second clock sub-signal.

Exemplarily, the second dummy sub-circuit 104 connected to the first stage of shift register unit GOA (1) may be turned on when the second turn-on sub-signal is at the first potential and transmit the second turn-on sub-signal to the first stage of shift register unit GOA (1). Alternatively, the second dummy sub-circuit 104 connected to the last stage of shift register unit GOA (m) may be turned on when the second turn-on sub-signal is at the first potential and transmit the second turn-on sub-signal to the last stage of shift register unit GOA (m).

Figure 4:
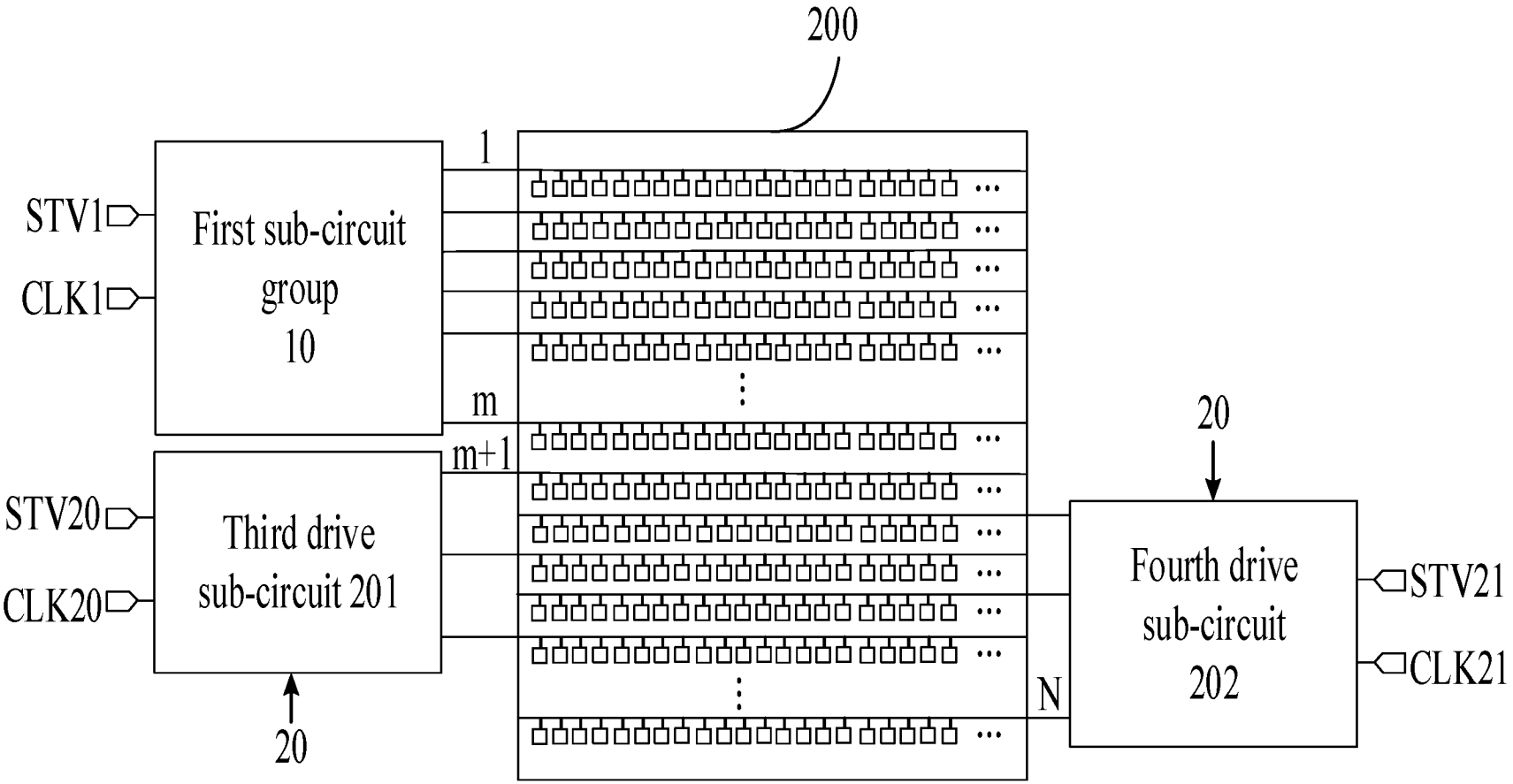
FIG. 4 is a schematic diagram of a structure of then another gate drive circuit applied in a display panel according to an embodiment of the present disclosure.
Figure 5:
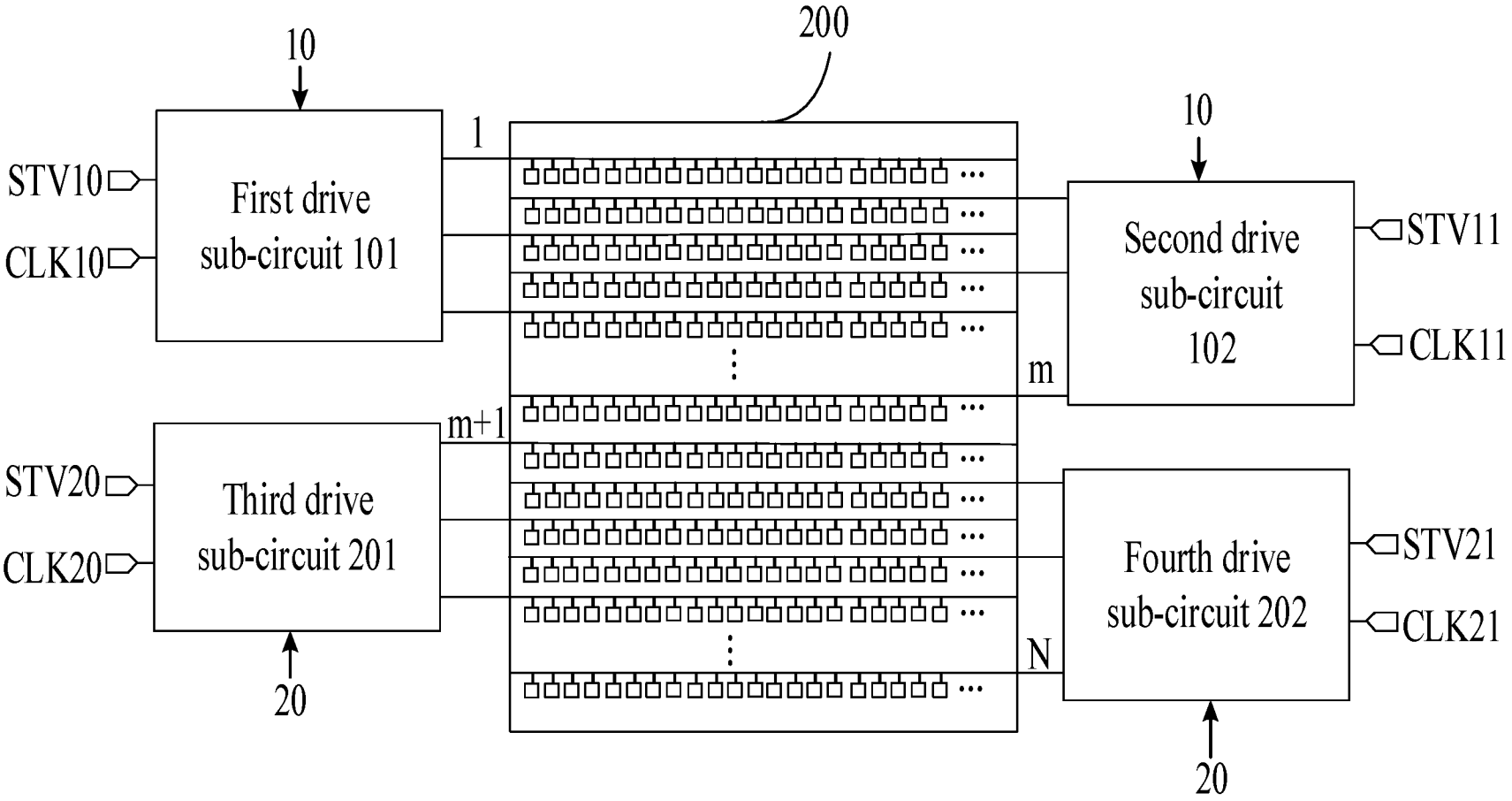
FIG. 5 is a schematic diagram of a structure of then another gate drive circuit applied in a display panel according to an embodiment of the present disclosure.

FIG. 4 is a schematic diagram of a structure of then another gate drive circuit applied in a display panel according to an embodiment of the present disclosure. FIG. 5 is a schematic diagram of a structure of then another gate drive circuit applied in a display panel according to an embodiment of the present disclosure. As shown in FIG. 4 and FIG. 5, the second sub-circuit group 20 may further include: a third drive sub-circuit 201 and a fourth drive sub-circuit 202. The second turn-on signal terminal STV2 may include: a third turn-on sub-signal terminal STV20 and a fourth turn-on sub-signal terminal STV21. The second clock signal terminal CLK2 may include: a third clock sub-signal terminal CLK20 and a fourth clock sub-signal terminal CLK21.

Referring to FIG. 4 and FIG. 5, the third drive sub-circuit 201 may be connected to the third turn-on sub-signal terminal STV20, the third clock sub-signal terminal CLK20, and odd-number rows of pixels from the $(m+1)^{th}$ row to the $N^{th}$ row of pixels, respectively. The third drive sub-circuit 201 may drive the odd-number rows of pixels from the $(m+1)^{th}$ row to the $N^{th}$ row of pixels row by row in response to a third turn-on sub-signal provided by the third turn-on sub-signal terminal STV20 and a third clock sub-signal provided by the third clock sub-signal terminal CLK20.

Here, the third drive sub-circuit 201 may include a plurality of cascaded GOA units. The input terminal of the first stage of GOA unit or the input terminal of the last stage of GOA unit may be connected to the third turn-on sub-signal terminal STV20. The first stage of GOA unit or the last stage of GOA unit connected the third turn-on sub-signal terminal STV20 may be turned on when the third turn-on sub-signal provided by the third turn-on sub-signal terminal STV20 is at the first potential, to drive one row of pixels connected thereto, and drive other stages of shift register units to turn on stage by stage sequentially.

Exemplarily, it is assumed that N is 1280 and m satisfies: m=N/2. That is, m is 640. The third drive sub-circuit 201 may be connected to the odd-number rows of pixels from the $641^{th}$ row to the $1280^{th}$ row of pixels. The third drive sub-circuit 201 may be turned on when the third turn-on sub-signal is at the first potential, and transmit the third turn-on sub-signal to the odd-number rows of pixels from the $641^{th}$ row to the $1280^{th}$ row of pixels row by row. That is, third drive sub-circuit 201 can drive the odd-number rows of pixels from the $641^{th}$ row to the $1280^{th}$ row of pixels row by row.

Referring to FIG. 4 and FIG. 5, the fourth drive sub-circuit 202 may be connected to the fourth turn-on sub-signal terminal STV21, the fourth clock sub-signal terminal CLK21, and even-number rows of pixels from the $(m+1)^{th}$ row to the $N^{th}$ row of pixels, respectively. The fourth drive sub-circuit 202 may drive the even-number rows of pixels from the $(m+1)^{th}$ row to the $N^{th}$ row of pixels row by row in response to a fourth turn-on sub-signal provided by the fourth turn-on sub-signal terminal STV21 and a fourth clock sub-signal provided by the fourth clock sub-signal terminal CLK21.

Here, the fourth drive sub-circuit 202 may include a plurality of cascaded GOA units. The input terminal of the first stage of GOA unit or the input terminal of the last stage of GOA unit may be connected to the fourth turn-on sub-signal terminal STV21. The first stage of GOA unit or the last stage of GOA unit connected the fourth turn-on sub-signal terminal STV21 may be turned on when the fourth turn-on sub-signal provided by the fourth turn-on sub-signal terminal STV210 is at the first potential to drive one row of pixels connected thereto, and drive other stages of shift register units to turn on stage by stage sequentially.

Exemplarily, it is assumed that N is 1280 and m satisfies: m=N/2. That is, m is 640. The fourth drive sub-circuit 202 may be connected to the even-number rows of pixels from the $641^{th}$ row to the $1280^{th}$ row of pixels. The fourth drive sub-circuit 202 may be turned on when the fourth turn-on sub-signal is at the first potential, and transmit the fourth turn-on sub-signal to the even-number rows of pixels from the $641^{th}$ row to the $1280^{th}$ row of pixels row by row. That is, fourth drive sub-circuit 202 can drive the even-number rows of pixels from the $641^{th}$ row to the $1280^{th}$ row of pixels row by row.

In the embodiments of the present disclosure, the clock cycle and the duty ratio of the third clock sub-signal may be same as those of the fourth clock sub-signal. For example, the duty ratios may both be 1/4. The time duration between the moment when the third turn-on sub-signal is at the first potential and the moment when the fourth turn-on sub-signal is at the first potential may be shorter than the clock cycle. Here, the moment when each turn-on sub-signal is at the first potential may refer to a moment when the potential of the turn-on sub-signal hops from the second potential to the first potential.

Correspondingly, the third drive sub-circuit 201 and the fourth drive sub-circuit 202 may alternately drive the last N-m rows of pixels row by row. That is, when the third drive sub-circuit 201 finishes driving an odd-number row of pixels of the last N-m rows of pixels, in one clock cycle, the fourth drive sub-circuit 202 may start driving an even-number row of pixels that is adjacent to and after the odd-number row of pixels. That is, the third drive sub-circuit 201 and the fourth drive sub-circuit 202 may sequentially drive the last N-m rows of pixels. In addition, in the clock cycle, after the fourth drive sub-circuit 202 finishes driving the even-number row of pixels, the first sub-circuit group 20 may start driving one or two rows of pixels of the first m rows of pixels.

Exemplarily, as shown in FIG. 5, it is assumed that the first sub-circuit group 10 includes: a first drive sub-circuit 101 and a second drive sub-circuit 102, the second sub-circuit group 20 includes: a third drive sub-circuit 201 and a fourth drive sub-circuit 202, and the third turn-on sub-signal, the fourth turn-on sub-signal, the first turn-on sub-signal, and the second turn-on sub-signal are at the first potential sequentially in one clock cycle. Then, in one clock cycle, the third drive sub-circuit 201 may be turned on first and drive the $(m+1)^{th}$ row of pixels of the last N-m rows of pixels. After the third drive sub-circuit 201 finishes driving, the fourth drive sub-circuit 202 may be turned on and drive the $(m+2)^{th}$ row of pixels of the last N-m rows of pixels. After the fourth drive sub-circuit 202 finishes driving, the first drive sub-circuit 101 may be turned on and drive the $(m-1)^{th}$ row of pixels of the first m rows of pixels. After the first drive sub-circuit 101 finishes driving, the second drive sub-circuit 102 may be turned on and drive the $m^{th}$ row of pixels of the first m rows of pixels. Afterwards, the plurality of stages of GOA units in each drive sub-circuit may be turned on stage by stage, and drive the N rows of pixels in accordance with the driving sequence of the third drive sub-circuit 201, the fourth drive sub-circuit 202, the first drive sub-circuit 101, and the second drive sub-circuit 102.

By disposing the first drive sub-circuit 101, the second drive sub-circuit 102, the third drive sub-circuit 201, and the fourth drive sub-circuit 202, the gate drive circuit can drive the odd-number rows of pixels and the even-number rows of pixels of the first m rows of pixels sequentially and the odd-number rows of pixels and the even-number rows of pixels of the last N-m rows of pixels sequentially in one clock cycle, which can further ensure that the liquid crystal molecules in the pixels in the middle region can deflect to the designated state, thereby ensuring the display effect in the middle region and also enriching the driving method of the gate drive circuit.

Optionally, when the timings of the first turn-on sub-signal, the second turn-on sub-signal, the third turn-on sub-signal, and the fourth turn-on sub-signal change, the turn-on sequence of the first drive sub-circuit 101, the second drive sub-circuit 102, the third drive sub-circuit 201, and the fourth drive sub-circuit 202 changes. Correspondingly, the sequence for driving the pixels by the gate drive circuit also changes.

Figure 6:
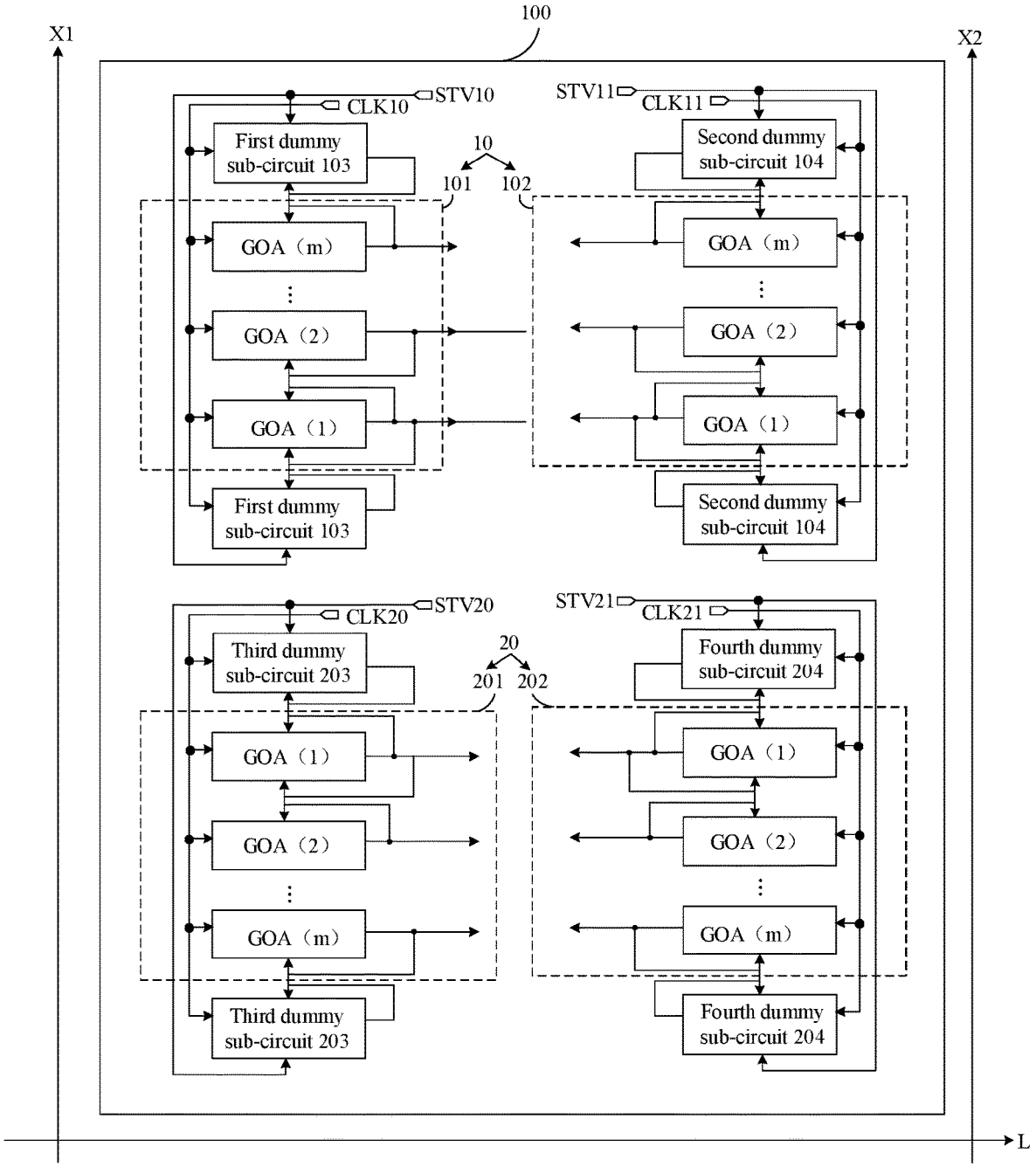
FIG. 6 is a schematic diagram of a structure of yet another gate drive circuit according to an embodiment of the present disclosure.

FIG. 6 is a schematic diagram of a structure of yet another gate drive circuit according to an embodiment of the present disclosure. As shown in FIG. 6, the third drive sub-circuit 201 and the fourth drive sub-circuit 202 may both include at least two cascaded shift register units. Each stage of shift register unit may be connected to one row of pixels (not shown in FIG. 6). Optionally, referring to FIG. 6, the second sub-circuit group 20 may further include: two third dummy sub-circuits 203 and two fourth dummy sub-circuits 204. The third dummy sub-circuits 203 and the fourth dummy sub-circuits 204 may also be referred to as dummy GOAs.

Each of the third dummy sub-circuits 203 may be connected to the third turn-on sub-signal terminal STV20 and the third clock sub-signal terminal CLK20 respectively. One of the third dummy sub-circuits 203 may further be connected to an input terminal of the first stage of shift register unit GOA (1) in the third drive sub-circuit 201 and configured to transmit the third turn-on sub-signal to the first stage of shift register unit GOA (1) in the third drive sub-circuit 201 under the drive of the third turn-on sub-signal and the third clock sub-signal. The other one of the third dummy sub-circuits 203 may further be connected to an input terminal of the last stage of shift register unit GOA (m) in the third drive sub-circuit 201 and configured to transmit the third turn-on sub-signal to the last stage of shift register unit GOA (m) in the third drive sub-circuit 201 under the drive of the third turn-on sub-signal and the third clock sub-signal.

Exemplarily, the third dummy sub-circuit 203 connected to the first stage of shift register unit GOA (1) may be turned on when the third turn-on sub-signal is at the first potential and transmit the third turn-on sub-signal to the first stage of shift register unit GOA (1). Alternatively, the third dummy sub-circuit 203 connected to the last stage of shift register unit GOA (m) may be turned on when the third turn-on sub-signal is at the first potential and transmit the third turn-on sub-signal to the last stage of shift register unit GOA (m).

Each of the fourth dummy sub-circuits 204 may be connected to the fourth turn-on sub-signal terminal STV21 and the fourth clock sub-signal terminal CLK21 respectively. One of the fourth dummy sub-circuits 204 may be connected to an input terminal of the first stage of shift register unit GOA (1) in the fourth drive sub-circuit 202 and configured to transmit the fourth turn-on sub-signal to the first stage of shift register unit GOA (1) in the fourth drive sub-circuit 202 under the drive of the fourth turn-on sub-signal and the fourth clock sub-signal. The other one of the fourth dummy sub-circuits 204 may also be connected to an input terminal of the last stage of shift register unit GOA (m) in the fourth drive sub-circuit 202 and configured to transmit the fourth turn-on sub-signal to the last stage of shift register unit GOA (m) in the fourth drive sub-circuit 202 under the drive of the fourth turn-on sub-signal and the fourth clock sub-signal.

Exemplarily, the fourth dummy sub-circuit 204 connected to the first stage of shift register unit GOA (1) may be turned on when the fourth turn-on sub-signal is at the first potential and transmit the fourth turn-on sub-signal to the first stage of shift register unit GOA (1). Alternatively, the fourth dummy sub-circuit 204 connected to the last stage of shift register unit GOA (m) may be turned on when the fourth turn-on sub-signal is at the first potential and transmit the fourth turn-on sub-signal to the last stage of shift register unit GOA (m).

It should be noted that all of the first dummy sub-circuit 103, the second dummy sub-circuit 104, the third dummy sub-circuit 203, and the fourth dummy sub-circuit 204 (i.e., Dummy GOA units) are not connected to any pixel rows, and the internal structure of the dummy GOA unit is the same as the internal structures of the GOA units included in the drive sub-circuits. As transmitting the turn-on sub-signals directly to the GOA units connected to the pixel rows may cause the problem of unreliable drive of the pixels due to unstable signals, the turn-on sub-signals can be transmitted to the drive sub-circuits by disposing the dummy sub-circuits, which can improve the stability of the turn-on sub-signals output to the drive sub-circuits, thereby improving the reliability of driving pixel rows by the drive sub-circuits.

Here, the turn-on sub-signal transmitted by each dummy sub-circuit to its connected shift register unit may be a clock sub-signal from a clock sub-signal terminal. For example, the first turn-on sub-signal transmitted by the first dummy sub-circuit 103 to the shift register unit in the first drive sub-circuit 101 may be a first clock sub-signal. The second turn-on sub-signal transmitted by the second dummy sub-circuit 104 to the shift register unit in the second drive sub-circuit 102 may be a second clock sub-signal. The third turn-on sub-signal transmitted by the third dummy sub-circuit 203 to the shift register unit in the third drive sub-circuit 201 may be a third clock sub-signal. The fourth turn-on sub-signal transmitted by the fourth dummy sub-circuit 204 to the shift register unit in the fourth drive sub-circuit 202 may be a fourth clock sub-signal.

It should be also noted that each stage of shift register unit included in the drive sub-circuit may include: an input module and a reset module. The input module included in each stage of shift register unit may be connected to a first control signal terminal CN and an input signal terminal (that is, the turn-on sub-signal terminal or the output terminal of the previous stage of shift register unit) respectively. The reset module may be connected to a second control signal terminal CNB and a reset signal terminal (that is, the turn-on sub-signal terminal or the output terminal of the next stage of shift register unit) respectively. The potential of the first control signal provided by first control signal terminal CN and the potential of the second control signal provided by second control signal terminal CNB may be complementary. That is, one control signal is at a high potential and the other one control signal is at a low potential.

Each stage of shift register unit may be turned on when the first control signal provided by the first control signal terminal CN is at the first potential or when the second control signal provided by the second control signal terminal CNB is at the first potential. Therefore, in the embodiments of the present disclosure, the potential of the first control signal and the potential of the second control signal may be adjusted to control the shift register unit turned on first in the drive sub-circuit.

For example, when the first control signal provided by the first control signal terminal CN is at the first potential and the second control signal provided by the second control signal terminal CNB is at the second potential, the stages of shift register units in the drive sub-circuit may be turned on sequentially starting from the first stage of shift register unit, thereby implementing forward scan.

When the first control signal provided by the first control signal terminal CN is at the second potential and the second control signal provided by the second control signal terminal CNB is at the first potential, the stages of shift register units in the drive sub-circuit may be turned on sequentially starting from the last stage of shift register unit, thereby implementing reverse scan.

Optionally, when the first sub-circuit group 10 includes the first drive sub-circuit 101 and the second drive sub-circuit 102, and the second sub-circuit group 20 includes the third drive sub-circuit 201 and the fourth drive sub-circuit 202, as shown in FIG. 6, the first drive sub-circuit 101 and the second drive sub-circuit 102 may be disposed oppositely on the two sides of the display panel 200, and the third drive sub-circuit 201 and the fourth drive sub-circuit 202 may also be disposed oppositely on the two sides of the display panel 200.

Additionally, referring to FIG. 6, the first drive sub-circuit 101 and the third drive sub-circuit 201 are on the same side of the display panel, and the second drive sub-circuit 102 and the fourth drive sub-circuit 202 are on the same side of the display panel. The extending direction X1 of the side edge of the side which the first drive sub-circuit 101 and the third drive sub-circuit 201 are on and the extending direction X2 of the side edge of the side which the second drive sub-circuit 102 and the fourth drive sub-circuit 202 are on are both perpendicular to the extending direction L of the gate line in the display panel 200.

By disposing the two drive sub-circuits included in each sub-circuit group oppositely on the two sides of the display panel and at the side edge perpendicular to the extending direction of the gate line, the space of the display panel can be utilized reasonably and the problem that the area of the display panel is relatively large is avoided, which helps implement a narrow-frame display panel.

In summary, the embodiments of the present disclosure provide a gate drive circuit. The gate drive circuit includes a first sub-circuit group and a second sub-circuit group. The first sub-circuit group can drive the $m^{th}$ row to the first row of pixels of the N rows of pixels in the display panel row by row, and the second sub-circuit group can drive the $(m+1)^{th}$ row to the $N^{th}$ row of pixels row by row. In addition, m is greater than 1 and less than N. Therefore, the gate drive circuit can drive the pixels row by row sequentially from a middle row of pixels to the two sides, such that the liquid crystal molecules in the middle region of the display panel can deflect to the designated state, which disperses the region in which the ghosting phenomenon may occur to the edge regions at the two ends of the display panel, thereby ensuring that the ghosting phenomenon does not occur in the middle region and improving the display effect.

Figure 7:
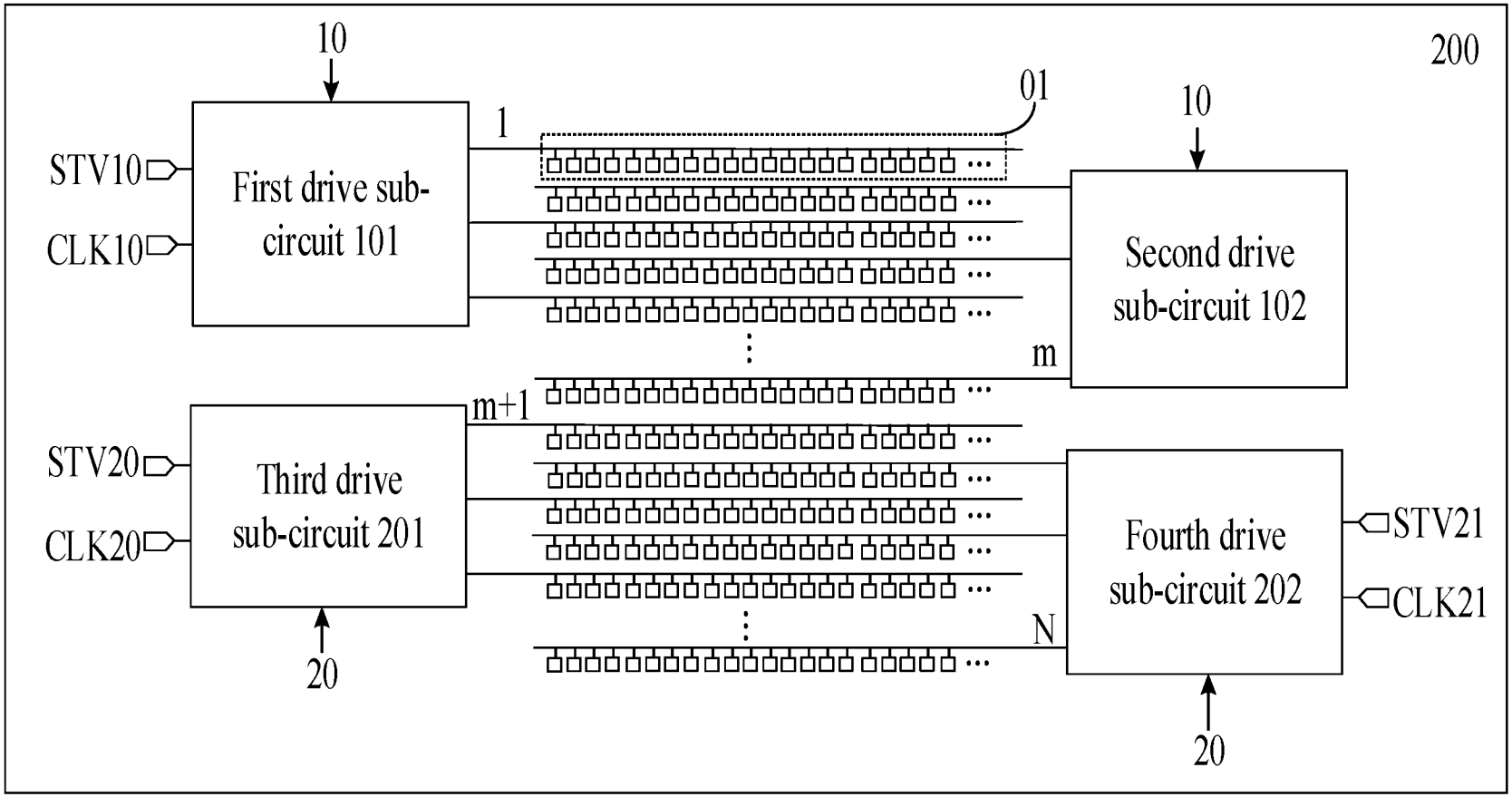
FIG. 7 is a schematic diagram of a structure of a display panel according to an embodiment of the present disclosure.

FIG. 7 is a schematic diagram of a structure of a display panel according to an embodiment of the present disclosure. As shown in FIG. 7, the display panel may include: N rows of pixels 01, and the gate drive circuit 100 provided in the above embodiments and connected to the N rows of pixels 01. The gate drive circuit 100 may be the circuit shown in any one of FIG. 1 to FIG. 6.

Exemplarily, the display panel may be a liquid crystal display panel. The liquid crystal display panel may include an array substrate, a color film substrate, and a liquid crystal between the array substrate and the color film substrate. The gate drive circuit 100 may be disposed on the array substrate.

The embodiments of the present disclosure further provide a display device. As an optional implementation, the display device may include the display panel in the above embodiment, for example, the display panel shown in FIG. 7.

Figure 8:
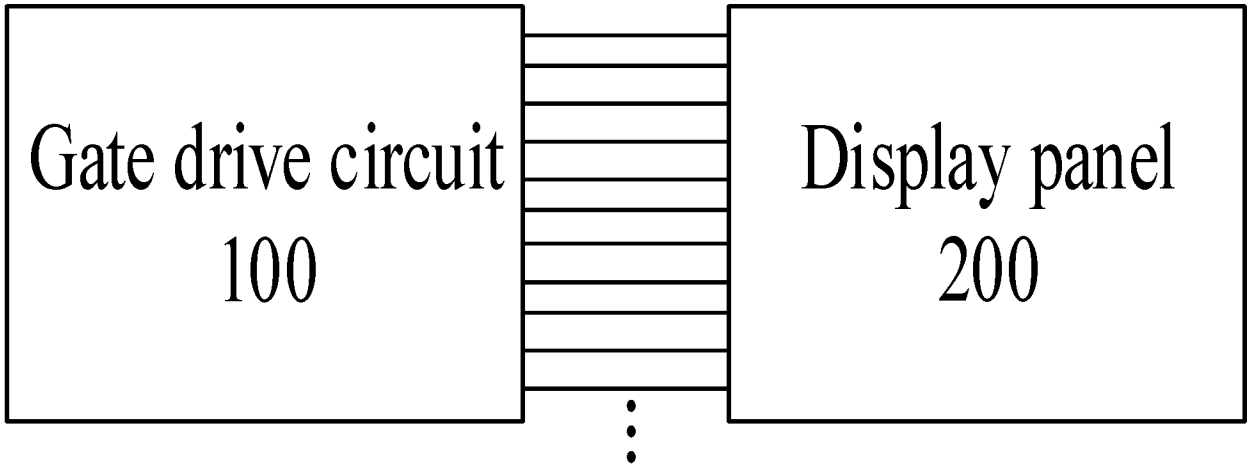
FIG. 8 is a schematic diagram of a structure of a display device according to an embodiment of the present disclosure.

As another optional implementation, FIG. 8 is a schematic diagram of a structure of a display device according to an embodiment of the present disclosure. As shown in FIG. 8, the display device may include: a display panel 200 and the gate drive circuit 100 provided in the above embodiments and connected to the display panel 200. The gate drive circuit 100 may be the gate drive circuit 100 shown in any one of FIG. 1 to FIG. 6. That is, in this implementation, the gate drive circuit 100 may be independently displosed from the display panel 200.

In the embodiments of the present disclosure, as shown in FIG. 1 to FIG. 6, the gate drive circuit 100 may include a first sub-circuit group 10 and a second sub-circuit group 20. The first sub-circuit group 10 may drive the $m^{th}$ row to the first row of pixels of the N rows of pixels included in the display panel row by row, and the second sub-circuit group 20 may drive the $(m+1)^{th}$ row to the $N^{th}$ row of pixels row by row. Additionally, the first sub-circuit group 10 and the second sub-circuit group 20 may alternately drive the pixels row by row from a middle row of pixels to the two sides.

That is, in one clock cycle, the gate drive circuit may drive one or two rows of pixels of the first m rows of pixels, and may drive one or two rows of pixels of the last N-m rows of pixels, and the like. Additionally, the time duration for finishing driving the first m rows of pixels by the first sub-circuit group 10 may be equal or close to the time duration for driving the last N-m rows of pixels by the second sub-circuit group 20. For example, the different between the two time durations may be less than one clock cycle. Thus, it is ensured that the liquid crystal molecules in the middle region may deflect to the designated state, thereby ensuring the display effect in the middle region.

Figure 9:
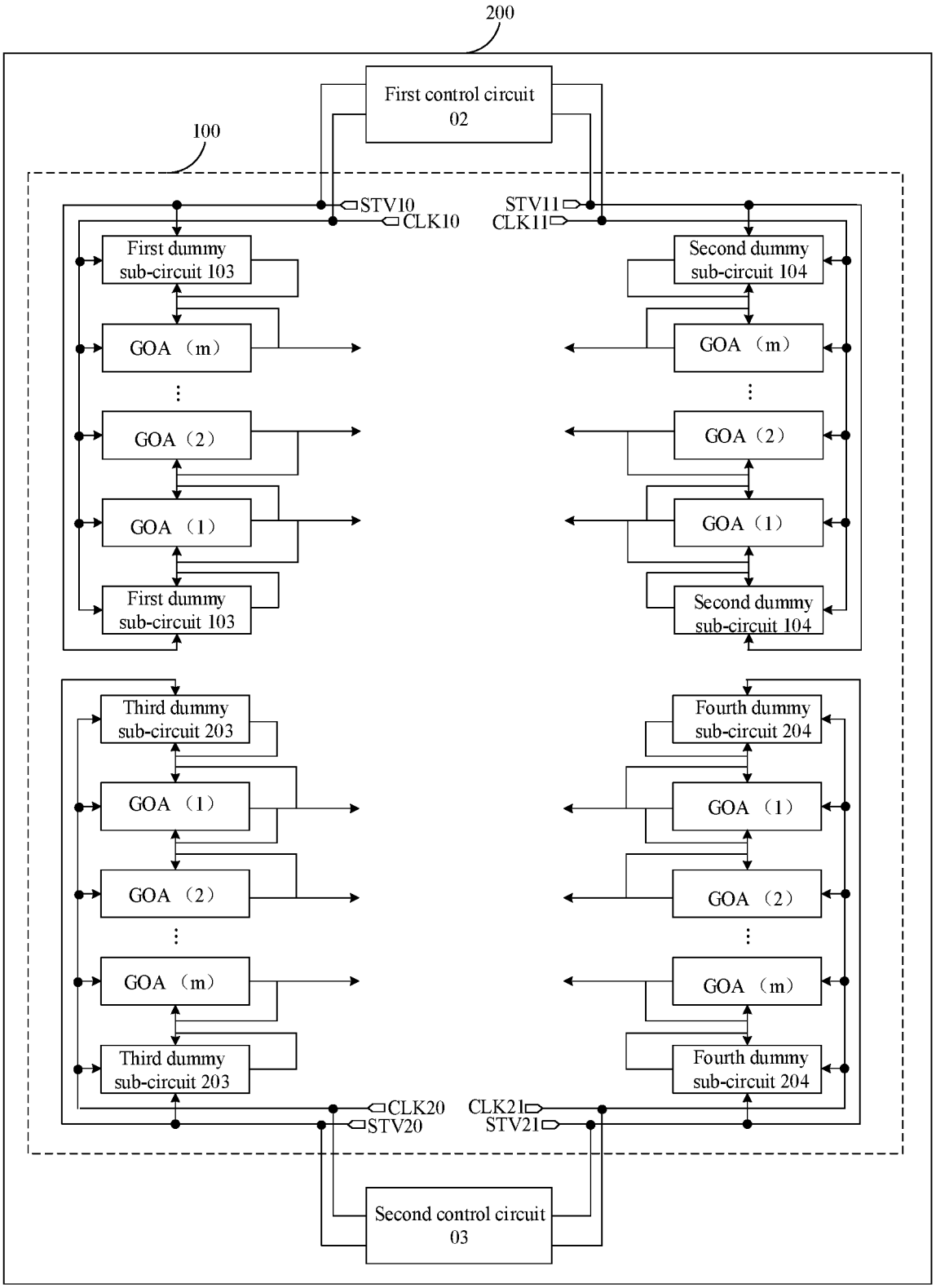
FIG. 9 is a schematic diagram of a structure of another display device according to an embodiment of the present disclosure.

Optionally, FIG. 9 is a schematic diagram of a structure of another display device according to an embodiment of the present disclosure. As shown in FIG. 9, the display device may further include: a first control circuit 02 and a second control circuit 03.

The first control circuit 02 may be connected to the first turn-on signal terminal STV1 (that is, the first turn-on sub-signal terminal STV10 and the second turn-on sub-signal terminal STV11) and the first clock signal terminal CLK1 (that is, the first clock sub-signal terminal CLK10 and the second clock sub-signal terminal CLK11) respectively. The first control circuit 02 may provide signals to the first turn-on signal terminal STV1 and the second clock signal terminal STV2. The second control circuit 03 may be connected to the second turn-on signal terminal STV2 (That is, the third turn-on sub-signal terminal STV20 and the fourth turn-on sub-signal terminal STV21) and the second clock signal terminal CLK2 (that is, the third clock sub-signal terminal CLK20 and the fourth clock sub-signal terminal CLK21) respectively. The second control circuit 03 may provide signals to the second turn-on signal terminal STV2 and the second clock signal terminal CLK2.

Optionally, referring to FIG. 9, the first control circuit 02 and the second control circuit 03 may be disposed oppositely on the two sides of the display panel 200. In addition, both the extending direction of the side edge of the side which the first control circuit 02 is on and the extending direction of the side edge of the side which the second control circuit 03 is on are parallel to the extending direction of the gate line in the display panel 200.

Here, the first control circuit 02 and the second control circuit 03 may both be independently disposed from the display panel and may both be integrated circuit (IC).

By disposing the two control circuits oppositely on two sides of the display panel and at the side edge parallel to the extending direction of the gate line, the space of the display panel can be utilized reasonably and the problem that the area of the display device is relatively large is avoided, which helps implement a narrow-frame display device.

It should be noted that the display panel may include only one control circuit. Correspondingly, the one control circuit may be connected to the first turn-on signal terminal STV1, the first clock single terminal CLK1, the second clock signal terminal STV2, and the second clock single terminal CLK2 respectively. The control circuit may provide signals to all of the first turn-on signal terminal STV1, the first clock single terminal CLK1, the second clock signal terminal STV2, and the second clock single terminal CLK2.

Optionally, the display device may be any product or part with a display function, such as a liquid crystal display device, a mobile phone, a tablet computer, a TV, a display, a laptop computer, a navigator, etc.

In summary, the embodiments of the present disclosure provide a display device. The gate drive circuit included in the display device can drive the pixels row by row sequentially from a middle row of pixels to the two sides, such that the liquid crystal molecules in the middle region of the display panel can deflect to the designated state, which disperses the region in which the ghosting phenomenon may occur to the edge regions at two ends of the display panel, thereby ensuring that the ghosting phenomenon does not occur in the middle region and improving the display effect.

Figure 10:
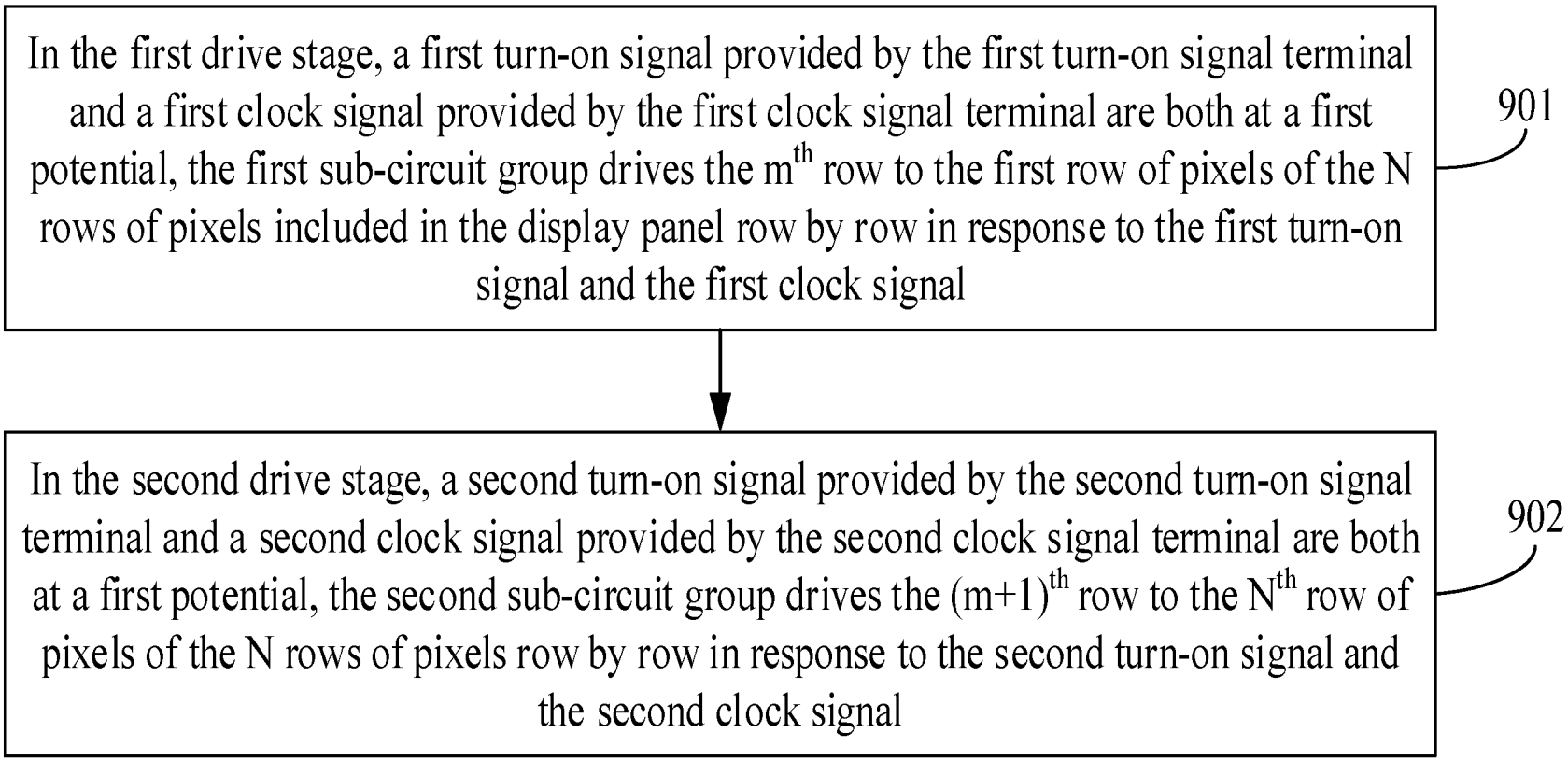
FIG. 10 is a flowchart of a method for driving a gate drive circuit according to an embodiment of the present disclosure.

FIG. 10 is a flowchart of a method for driving a gate drive circuit according to an embodiment of the present disclosure. This method may be applied to the gate drive circuit shown in any one of FIG. 1 to FIG. 6. As shown in FIG. 10, the method may include the following steps.

In step 901, in the first drive stage, a first turn-on signal provided by the first turn-on signal terminal and a first clock signal provided by the first clock signal terminal are both at a first potential. The first sub-circuit group drives the $m^{th}$ row to the first row of pixels of the N rows of pixels included in the display panel row by row in response to the first turn-on signal and the first clock signal.

In step 902, in the second drive stage, a second turn-on signal provided by the second turn-on signal terminal and a second clock signal provided by the second clock signal terminal are both at a first potential. The second sub-circuit group drives the $(m+1)^{th}$ row to the $N^{th}$ row of pixels of the N rows of pixels row by row in response to the second turn-on signal and the second clock signal.

Here, the time duration between the moment when the first turn-on signal is at the first potential and the moment when the second turn-on signal is at the first potential is less than a clock cycle of a clock signal. N is an integer greater than 1, and m is an integer greater than 1 and less than N. That is, the first sub-circuit group may drive the pixels row by row from a middle row to the two sides in the display panel.

In addition, the time duration between the moment when the first turn-on signal is at the first potential and the moment when the second turn-on signal is at the first potential is less than a clock cycle of a clock signal. Therefore, the first sub-circuit group 10 and the second sub-circuit group 20 may also alternately drive the pixels row by row from a row of pixels in the middle to the two sides in the display panel. That is, when the first sub-circuit group finishes driving a row of pixels of the first m rows of pixels, in one clock cycle, the second sub-circuit group may start driving a row of pixels of the last N-m rows of pixels. That is, in each clock cycle, the first sub-circuit group 10 and the second sub-circuit group 20 may alternately drive the pixels.

Additionally, when the first turn-on signal and the second turn-on signal have different timings, the driving sequences of the gate drive circuit may be different. Optionally, in the first sub-circuit group 10 and the second sub-circuit group 20, one sub-circuit group may drive one row of pixels first, and then the other sub-circuit group may drive one row of pixels, and the like. Alternatively, one sub-circuit group may drive two rows of pixels row by row first, and then the other sub-circuit group may drive two rows of pixels row by row, and the like. Alternatively, one sub-circuit group may drive one row of pixels first, and then the other sub-circuit group may drive two rows of pixels row by row, and the like. Alternatively, one sub-circuit group may drive two rows of pixels row by row first, and then the other sub-circuit group may drive one row of pixels, and the like. The driving method is not limited in the embodiments of the present disclosure. Additionally, the time duration for driving the first m rows of pixels by the first sub-circuit group 10 may be equal or close to the time duration for driving the last N-m rows of pixels by the second sub-circuit group 20 (For example, the difference between the two time durations may be less than one clock cycle).

By driving the pixels row by row sequentially and alternatively from a middle row of pixels to the two sides in the display panel, the region in which the response time of the liquid crystal molecules is insufficient may disperse to the edge regions at two sides of the display panel, which ensures that the liquid crystal molecules in the middle region can deflect to the designated state, thereby ensuring that no ghosting phenomenon occurs in the middle region of the display panel. As to the VR field, users' viewing experience when the VR head-mounted display device is used can be improved.

In summary, the embodiments of the present disclosure provide a method for driving a gate drive circuit. In the gate drive circuit, the first sub-circuit group can drive the $m^{th}$ row to the first row of pixels of the N rows of pixels in the display panel row by row and the second sub-circuit group can drive the $(m+1)^{th}$ row to the $N^{th}$ row of pixels row by row. Also, m is greater than 1 and less than N. Thus, the gate drive circuit can drive the pixels row by row sequentially from a middle row of pixels to the two sides in the display panel, such that the liquid crystal molecules in the middle region of the display panel can deflect to the designated state, to disperse the region where the ghosting phenomenon may occur to the edge regions at the sides of the display panel, thereby ensuring that no ghosting phenomenon occurs in the middle region of the display panel, and improving the display effect.

Figure 11:
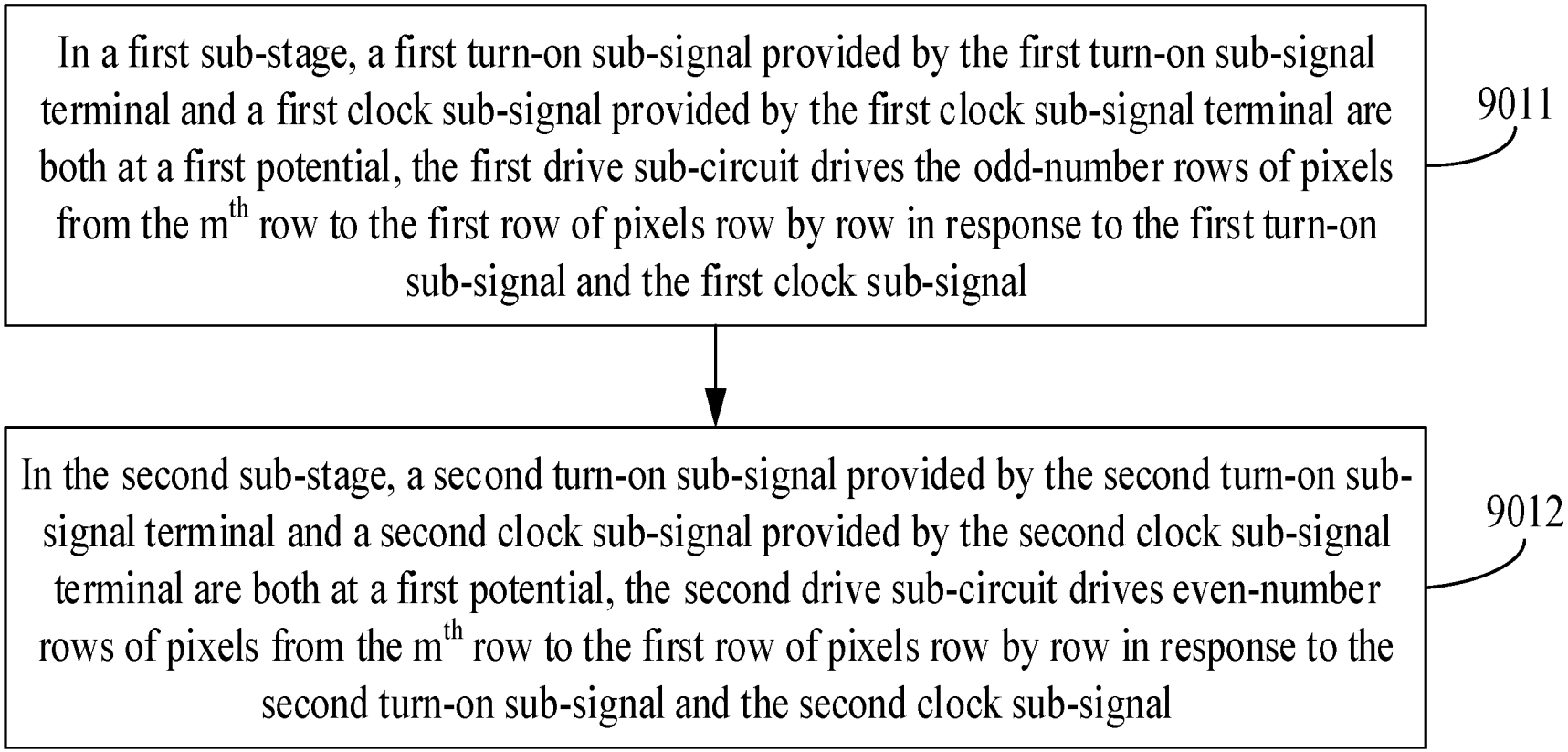
FIG. 11 is a flowchart of another method for driving a gate drive circuit according to an embodiment of the present disclosure.

Optionally, as shown in FIG. 2, FIG. 3, FIG. 5, and FIG. 6, the first sub-circuit group 10 includes: a first drive sub-circuit 101 and a second drive sub-circuit 102. The first turn-on signal terminal STV1 includes: a first turn-on sub-signal terminal STV10 and a second turn-on sub-signal terminal STV11. The first clock signal terminal CLK1 includes: a first clock sub-signal terminal CKK10 and a second clock sub-signal terminal CLK11. Correspondingly, as shown in FIG. 11, the above step 901 may include (that is, the first drive stage may include) the following steps.

In step 9011, in a first sub-stage, a first turn-on sub-signal provided by the first turn-on sub-signal terminal and a first clock sub-signal provided by the first clock sub-signal terminal are both at a first potential. The first drive sub-circuit drives the odd-number rows of pixels from the $m^{th}$ row to the first row of pixels row by row in response to the first turn-on sub-signal and the first clock sub-signal.

Exemplarily, it is assumed that m is an even number. In the first sub-stage, the first stage of GOA unit in the first drive sub-circuit 101 may be turned on under the drive of the first turn-on sub-signal, and may output the first clock sub-signal at the first potential to one row of pixels (i.e., the $(m-1)^{th}$ row of pixels) connected to the first stage of GOA, thereby driving the $(m-1)^{th}$ row of pixels. Afterwards, other stages of GOA units cascaded to the first stage of GOA may be turned on stage by stage sequentially, and may output the first clock sub-signal at the first potential to the correspondingly connected row of pixels row by row, thereby driving the other odd-number rows of pixels from the $m^{th}$ row to the first row of pixels row by row.

In step 9012, in the second sub-stage, a second turn-on sub-signal provided by the second turn-on sub-signal terminal and a second clock sub-signal provided by the second clock sub-signal terminal are both at a first potential, the second drive sub-circuit drives even-number rows of pixels from the $m^{th}$ row to the first row of pixels row by row in response to the second turn-on sub-signal and the second clock sub-signal.

Exemplarily, in the second sub-stage, the first stage of GOA unit in the second drive sub-circuit 102 may be turned on under the drive of the second turn-on sub-signal, and may output the second sub-signal at the first potential to one row of pixels (i.e., the $m^{th}$ row of pixels) connected to the first stage of GOA unit, thereby driving the $m^{th}$ row of pixels. Afterwards, other stages of GOA units cascaded to the first stage of GOA unit may be turned on stage by stage sequentially, and may output the first clock sub-signal at the first potential to one correspondingly connected row of pixels row by row, thereby driving the other even-number rows of pixels from the $m^{th}$ row to the first row of pixels row by row.

In the embodiments of the present disclosure, the clock cycle and the duty ratio of the first clock sub-signal may be same as those of the second clock sub-signal. For example, the duty ratios may both be 1/4. In addition, the time duration between the moment when the first turn-on sub-signal is at the first potential and the moment when the second turn-on sub-signal is at the first potential may be shorter than the clock cycle. Correspondingly, when the first drive sub-circuit 101 finishes driving an odd-number row of pixels of the first m rows of pixels, in one clock cycle, the second drive sub-circuit 102 may drive an even-number row of pixels that is adjacent to and after the odd-number row of pixels. That is, the first drive sub-circuit 101 and the second drive sub-circuit 102 may sequentially drive the first m rows of pixels (that is, sequentially perform the first sub-stage and the second sub-stage). In addition, in one clock cycle, after the second drive sub-circuit 102 finishes driving the even-number row of pixels, the second sub-circuit group 20 may start driving one or two rows of pixels of the last N-m rows of pixels.

Optionally, when the timings of the first turn-on sub-signal, the second turn-on sub-signal, and the second turn-on signal change in one clock cycle, the sequence in which the first drive sub-circuit 101, the second drive sub-circuit 102, and the second sub-circuit group 20 are turned on changes. Correspondingly, the sequence for driving the pixels by the gate drive circuit also changes. By driving the odd-number rows of pixels and the even-number rows of pixels of the first m rows of pixels sequentially in one clock cycle, it can further ensure that the liquid crystal molecules in the pixels in the middle region of the first m rows of pixels can deflect to the designated state, thereby ensuring the display effect in the middle region and also enriching the driving method of the gate drive circuit.

Figure 12:
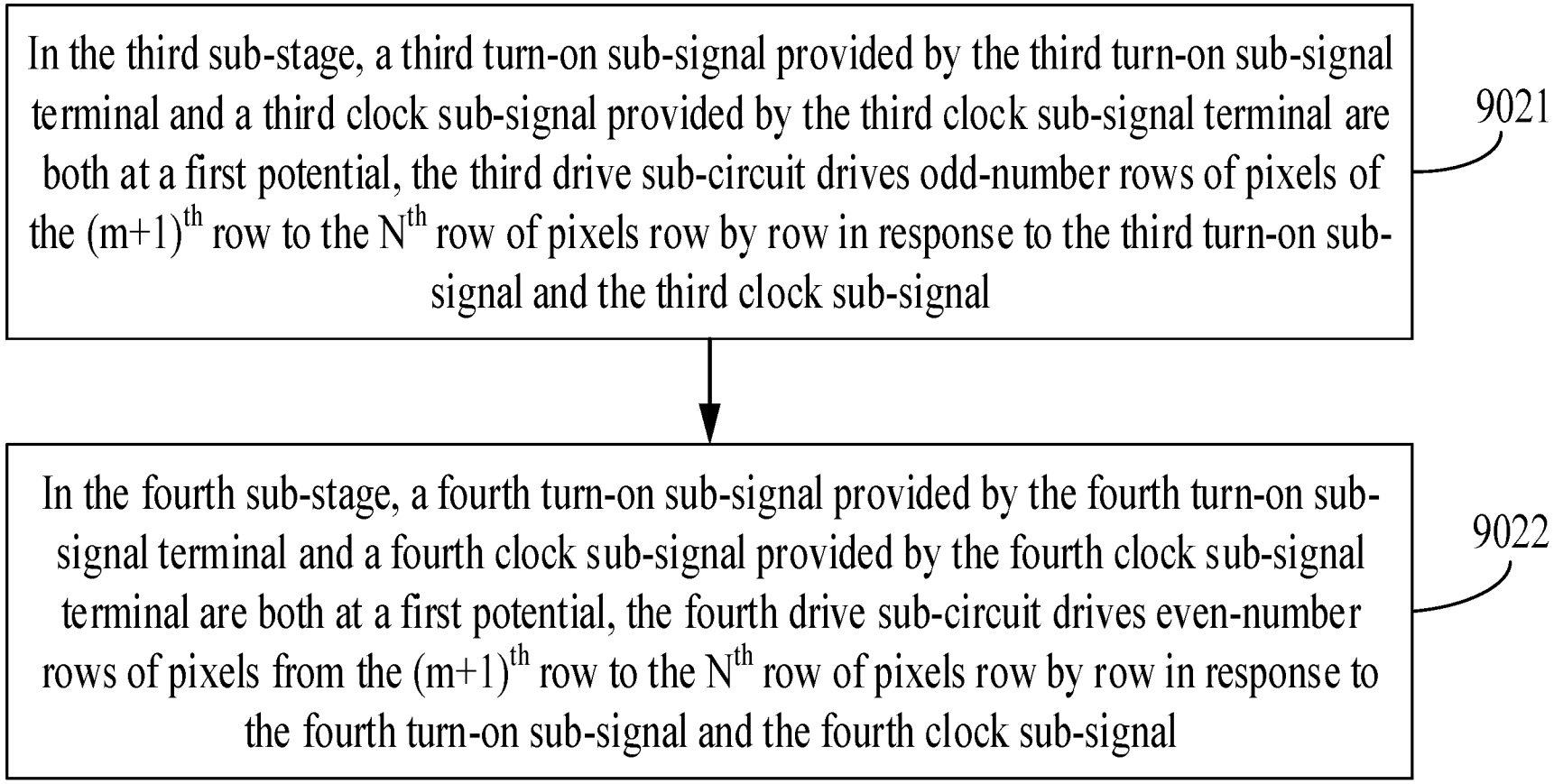
FIG. 12 is a flowchart of yet another method for driving a gate drive circuit according to an embodiment of the present disclosure.

Optionally, as shown in FIG. 4 and FIG. 6, the second sub-circuit group 20 includes: a third drive sub-circuit 201 and a fourth drive sub-circuit 202. The second turn-on signal terminal STV2 includes: a third turn-on sub-signal terminal STV20 and a fourth turn-on sub-signal terminal STV21. The second clock signal terminal CLK2 includes: a third clock sub-signal terminal CLK20 and a fourth clock sub-signal terminal CLK21. Correspondingly, as shown in FIG. 12, the above step 902 (i.e., the second drive stage) may include following steps.

In step 9021, in a third sub-stage, a third turn-on sub-signal provided by the third turn-on sub-signal terminal and a third clock sub-signal provided by the third clock sub-signal terminal are both at a first potential, the third drive sub-circuit drives odd-number rows of pixels of the $(m+1)^{th}$ row to the $N^{th}$ row of pixels row by row in response to the third turn-on sub-signal and the third clock sub-signal.

Exemplarily, it is assumed that m is an even number. In the third sub-stage, the first stage of GOA unit in the third drive sub-circuit 201 may be turned on under the drive of the third turn-on sub-signal, and may output the third clock sub-signal at the first potential to one row of pixels (i.e., the $(m+1)^{th}$ row of pixels) connected to the first stage of GOA unit, thereby driving the $(m+1)^{th}$ row of pixels. Afterwards, other stages of GOA units cascaded to the first stage of GOA unit may be turned on stage by stage sequentially, and may output the third clock sub-signal at the first potential to one correspondingly corrected row of pixels row by row, thereby driving the other odd-number rows of pixels from the $(m+1)^{th}$ row to the $N^{th}$ row of pixels row by row.

In step 9022, in the fourth sub-stage, a fourth turn-on sub-signal provided by the fourth turn-on sub-signal terminal and a fourth clock sub-signal provided by the fourth clock sub-signal terminal are both at a first potential, the fourth drive sub-circuit drives even-number rows of pixels from the $(m+1)^{th}$ row to the $N^{th}$ row of pixels row by row in response to the fourth turn-on sub-signal and the fourth clock sub-signal.

Exemplarily, in the fourth sub-stage, the first stage of GOA unit in the fourth drive sub-circuit 202 may be turned on under the drive of the fourth turn-on sub-signal, and may output the fourth clock sub-signal at the first potential to one row of pixels (i.e., the $(m+2)^{th}$ row of pixels) connected to the first stage of GOA unit, thereby driving the $(m+2)^{th}$ row of pixels. Afterwards, other stages of GOA units cascaded to the first stage of GOA unit may be turned on stage by stage sequentially, and may output the fourth clock sub-signal at the first potential to one correspondingly connected row of pixels row by row, thereby driving the other even-number rows of pixels from the $(m+1)^{th}$ row to the $N^{th}$ row of pixels row by row.

In the embodiments of the present disclosure, the clock cycle and the duty ratio of the third clock sub-signal may be same as those of the fourth clock sub-signal. For example, the duty ratios may both be 1/4. In addition, the time duration between the moment when the third turn-on sub-signal is at the first potential and the moment when the fourth turn-on sub-signal is at the first potential may be shorter than the clock cycle. Correspondingly, the third drive sub-circuit 201 and the fourth drive sub-circuit 202 may alternately drive the last N-m rows of pixels row by row. That is, when the third drive sub-circuit 201 finishes driving an odd-number row of pixels of the last N-m rows of pixels, in one clock cycle, the fourth drive sub-circuit 202 may drive an even-number row of pixels that is adjacent to and after the odd-number row of pixels. That is, the third drive sub-circuit 201 and the fourth drive sub-circuit 202 may sequentially drive the last N-m rows of pixels. In addition, in the one clock cycle, after the fourth drive sub-circuit 202 finishes driving the even-number row of pixels, the first sub-circuit group 10 may start driving one or two rows of pixels of the first m rows of pixels.

Optionally, when the timings of the first turn-on signal, the third turn-on sub-signal, and the fourth turn-on sub-signal change in one clock cycle, the sequence in which the third drive sub-circuit 201, the fourth drive sub-circuit 202, and the first sub-circuit group 10 are turned on changes. Correspondingly, the sequence for driving the pixels by the gate drive circuit also changes. By driving the odd-number rows of pixels and the even-number rows of pixels of the last N-m rows of pixels sequentially in one clock cycle, it can further ensure that the liquid crystal molecules in the pixels in the middle region of the last N-m rows of pixels can deflect to the designated state, thereby ensuring the display effect in the middle region and also enriching the driving method of the gate drive circuit.

Figure 13:
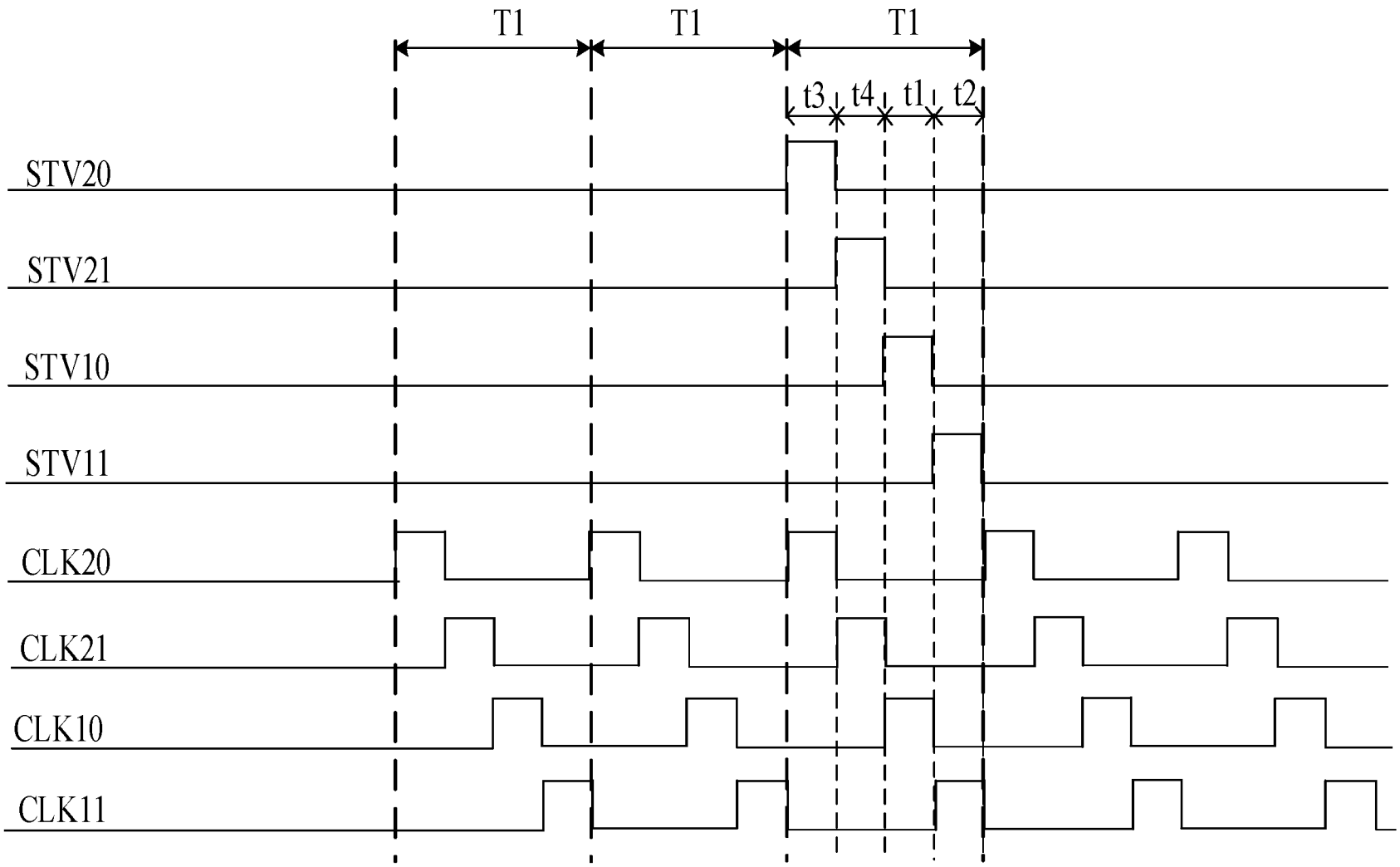
FIG. 13 is a timing diagram of respective signal terminals in a gate drive circuit according to an embodiment of the present disclosure.

Optionally, FIG. 13 is a timing diagram of respective signal terminals in a gate drive circuit by taking the gate drive circuit shown in FIG. 6 as an example in an embodiment of the present disclosure. As shown in FIG. 13, the third turn-on sub-signal provided by the third turn-on sub-signal terminal STV20, the fourth turn-on sub-signal provided by the fourth turn-on sub-signal terminal STV21, the first turn-on sub-signal provided by the first turn-on sub-signal terminal STV10, and the second turn-on sub-signal provided by the second turn-on sub-signal terminal STV11 may be at the first potential sequentially. Correspondingly, the first stage of GOA units in the third drive sub-circuit 201, the fourth drive sub-circuit 202, the first drive sub-circuit 101, and the second drive sub-circuit 102 may be turned on sequentially under the drive of the corresponding turn-on sub-signals.

Additionally, as shown in FIG. 13, when the third turn-on sub-signal is at the first potential, the third clock sub-signal provided by the third clock sub-signal terminal CLK20 is at the first potential. When the fourth turn-on sub-signal is at the first potential, the fourth clock sub-signal provided by the fourth clock sub-signal terminal CLK21 is at the first potential. When the first turn-on sub-signal is at the first potential, the first clock sub-signal provided by the first clock sub-signal terminal CLK10 is at the first potential. When the second turn-on sub-signal is at the first potential, the second clock sub-signal provided by the second clock sub-signal terminal CLK11 is at the first potential.

It is assumed that m is an even number. When the first stage of GOA unit in the third drive sub-circuit 201 is turned on, the clock signal at the first potential is directly transmitted to one correspondingly connected row of pixels (i.e., the $(m+1)^{th}$ row of pixels), thereby driving the $(m+1)^{th}$ row of pixels. When the first stage of GOA unit in the fourth drive sub-circuit 202 is turned on, the clock signal at the first potential is directly transmitted to one correspondingly connected row of pixels (i.e., the $(m+2)^{th}$ row of pixels), thereby driving the $(m+2)^{th}$ row of pixels. When the first stage of GOA unit in the first drive sub-circuit 101 is turned on, the clock signal at the first potential is directly transmitted to one correspondingly connected row of pixels (i.e., the $(m-1)^{th}$ row of pixels), thereby driving the $(m-1)^{th}$ row of pixels. When the first stage of GOA unit in the second drive sub-circuit 102 is turned on, the clock signal at the first potential is directly transmitted to one correspondingly connected row of pixels (i.e., the $m^{th}$ row of pixels), thereby driving the $m^{th}$ row of pixels.

Furthermore, referring to FIG. 13, after each respective turn-on sub-signal is sequentially at the first potential, each respective clock sub-signals may output clock signals periodically according to the sequence that the third clock sub-signal, the fourth clock sub-signal, the first clock sub-signal, and the second clock sub-signal are sequentially at the first potential. Correspondingly, other stages of shift register units in the respective drive sub-circuits may be turned on stage by stage, thereby driving the pixels row by row.

Exemplarily, as shown in FIG. 13, it is assumed that the third turn-on sub-signal, the fourth turn-on sub-signal, the first turn-on sub-signal, and the second turn-on sub-signal are sequentially at the first potential in each clock cycle. In the first clock cycle, the third drive sub-circuit 201 may be turned on first, and may drive the $(m+1)^{th}$ row of pixels of the last N-m rows of pixels. Then, after the third drive sub-circuit 201 finishes driving, the fourth drive sub-circuit 202 may be turned on and may start driving the $(m+2)^{th}$ row of pixels of the last N-m rows of pixels. Afterwards, after the fourth drive sub-circuit 202 finishes driving, the first drive sub-circuit 101 may be turned on and may start driving the $(m-1)^{th}$ row of pixels of the first m rows of pixels. Lastly, after the first drive sub-circuit 101 finishes driving, the second drive sub-circuit 102 may be turned on and may start driving the $m^{th}$ row of pixels of the first m rows of pixels.

Afterwards, the plurality of stages of GOA units in each drive sub-circuit may be turned on stage by stage, and drive the N rows of pixels according to the driving sequence of the third drive sub-circuit 201, the fourth drive sub-circuit 202, the first drive sub-circuit 101, and the second drive sub-circuit 102.

By driving the odd-number rows of pixels and the even-number rows of pixels of the first m rows of pixels and the odd-number rows of pixels and the even-number rows of pixels of the last N-m rows of pixels sequentially in one clock cycle, it can further ensure that the liquid crystal molecules of the pixels in the middle region can deflect to the designated state, thereby ensuring the display effect in the middle region and also enriching the driving method of the gate drive circuit.

Optionally, when the timings of the first turn-on sub-signal, the second turn-on sub-signal, the third turn-on sub-signal, and the fourth turn-on sub-signal change in one clock cycle, the sequence in which the first drive sub-circuit 101, the second drive sub-circuit 102, the third drive sub-circuit 201, and the fourth drive sub-circuit 202 included in the gate drive circuit are turned on changes. Correspondingly, the sequence for driving the pixels by the gate drive circuit also changes, which is not repeated in the embodiments of the present disclosure.

Optionally, the clock cycles of the third clock sub-signal, the fourth clock sub-signal, the first clock sub-signal, and the second clock sub-signal may be the same. For example, FIG. 13 shows that the cycle of each clock signal is T1. In addition, the duty ratio of each clock sub-signal is 1/4. In each clock cycle, the third clock sub-signal, the fourth clock sub-signal, the first clock sub-signal, and the second clock sub-signal may be at the first potential sequentially. That is, the third drive sub-circuit 201, the fourth drive sub-circuit 202, the first drive sub-circuit 101, and the second drive sub-circuit 102 may be turned on sequentially and drive one row of pixels.

In the embodiments of the present disclosure, the time duration between the moments when the potentials of two adjacent turn-on sub-signals hop to the first potential (i.e., the time difference between the moments when the potentials of two adjacent turn-on sub-signals hop to the first potential) may be equal to the time duration when the clock signal is at the first potential in each clock cycle. As the duty ratio refers to the time duration when the clock signal is at the first potential in each clock cycle, the time difference between the moments when the potentials of two adjacent turn-on sub-signals hop to the first potential may be equal to the product of the clock cycle and the duty ratio.

Additionally, in the embodiments of the present disclosure, before the first drive stage and the second drive stage, the driving method may further include: a dummy drive stage. In the dummy drive stage, the first turn-on signal provided by the first turn-on signal STV1 and the second turn-on signal provided by the second turn-on signal STV2 are both at the second potential. The first clock signal terminal CLK1 normally provides the first clock signal and the second clock signal terminal CLK2 normally provides the second clock signal.

Optionally, the time duration of the dummy drive stage may be equal to two clock cycles.

Exemplarily, it can further be known from FIG. 13 that before the first turn-on sub-signal (i.e., the third turn-on sub-signal) is at the first potential, the control circuit has already output the clock signal to the clock signal terminal connected to the gate drive circuit. That is, before the third sub-stage t3, the third clock sub-signal, the fourth clock sub-signal, the first clock sub-signal, and the second clock sub-signal have already been at the first potential sequentially. For example, in the timing diagram as shown in FIG. 13, before the third sub-stage t3, the control circuit has already provided the clock signal for two clock cycles T1 to each clock signal terminal.

By outputting the clock signal to the clock signal terminal connected to the gate drive circuit in advance, it can ensure that the corresponding clock sub-signal is at the first potential when the first turn-on sub-signal is at the first potential, thereby ensuring the reliability of driving the pixels by the gate drive circuit.

In summary, the embodiments of the present disclosure provide a method for driving a gate drive circuit. In the gate drive circuit, the first sub-circuit group included can drive the $m^{th}$ row to the first row of pixels of the N rows of pixels in the display panel row by row, and the second sub-circuit group can drive the $(m+1)^{th}$ row to the $N^{th}$ row of pixels row by row. In addition, m is greater than 1 and less than N. Therefore, the gate drive circuit can drive the pixels row by row sequentially from a middle row of pixels to the two sides in the display panel, such that the liquid crystal molecules in the middle region of the display panel can deflect to the designated state, which disperses the region in which the ghosting phenomenon may occur to the edge regions at two ends of the display panel, thereby ensuring that the ghosting phenomenon does not occur in the middle region and improving the display effect.

Persons of ordinary skill in the art may clearly understand that, for the convenience and conciseness of description, the specific working process of the gate drive circuit described above may be made reference to the corresponding process in the foregoing method embodiments, and details are not repeated here.

The foregoing descriptions are merely optional embodiments of the present disclosure, and are not intended to limit the present disclosure. Within the spirit and principles of the disclosure, any modifications, equivalent substitutions, improvements, etc., are within the protection scope of the present disclosure.

What is claimed is:

1. A method for driving a gate drive circuit, wherein the gate drive circuit comprises: a first sub-circuit group and a second sub-circuit group; the first sub-circuit group is connected to a first turn-on signal terminal, a first clock signal terminal, and an $m^{th}$ row to a first row of pixels of N rows of pixels included in a display panel, respectively; and the second sub-circuit group is connected to a second turn-on signal terminal, a second clock signal terminal, and an $(m+1)^{th}$ row to an $N^{th}$ row of pixels of the N rows of pixels, respectively; the method comprising:

in a first drive stage during which a first turn-on signal provided by the first turn-on signal terminal and a first clock signal provided by the first clock signal terminal are both at a first potential, driving, by the first sub-circuit group, the $m^{th}$ row to the first row of pixels of the N rows of pixels included in the display panel row by row in response to the first turn-on signal and the first clock signal; and in a second drive stage during which a second turn-on signal provided by the second turn-on signal terminal and a second clock signal provided by the second clock signal terminal are both at a first potential, driving, by the second sub-circuit group, the $(m+1)^{th}$ row to the $N^{th}$ row of pixels of the N rows of pixels row by row in response to the second turn-on signal and the second clock signal;

wherein a time duration between a moment when the first turn-on signal is at the first potential and a moment when the second turn-on signal is at the first potential is less than a clock cycle of a clock signal, N is an integer greater than 1, and m is an integer greater than 1 and less than N; and, the first turn-on signal terminal comprises: a first turn-on sub-signal terminal and a second turn-on sub-signal terminal; and the first clock signal terminal comprises: a first clock sub-signal terminal and a second clock sub-signal terminal;

wherein the third turn-on sub-signal, the fourth turn-on sub-signal, a first turn-on sub-signal provided by the first turn-on sub-signal terminal, and a second turn-on sub-signal provided by the second turn-on sub-signal terminal are at a first potential sequentially, when the third turn-on sub-signal is at the first potential, the third clock sub-signal is at the first potential; when the fourth turn-on sub-signal is at the first potential, the fourth clock sub-signal is at the first potential; when the first turn-on sub-signal is at the first potential, a first clock sub-signal provided by the first clock sub-signal terminal is at the first potential, and when the second turn-on sub-signal is at the first potential, a second clock sub-signal provided by the second clock sub-signal terminal is at the first potential;

wherein the third clock sub-signal, the fourth clock sub-signal, the first clock sub-signal, and the second clock sub-signal have the same clock cycle and the same duty ratio of 1/4, and in each clock cycle, the third clock sub-signal, the fourth clock sub-signal, the first clock sub-signal and the second clock sub-signal are at the first potential sequentially.

2. The method according to claim 1, wherein the first sub-circuit group comprise: a first drive sub-circuit and a second drive sub-circuit; the first turn-on signal terminal comprises: a first turn-on sub-signal terminal and a second turn-on sub-signal terminal; the first clock signal terminal comprises: a first clock sub-signal terminal and a second clock sub-signal terminal; and the first drive stage comprises:

a first sub-stage during which a first turn-on sub-signal provided by the first turn-on sub-signal terminal and a first clock sub-signal provided by the first clock sub-signal terminal are both at a first potential, driving, by the first drive sub-circuit, odd-number rows of pixels of the $m^{th}$ row to the first row of pixels row by row in response to the first turn-on sub-signal and the first clock sub-signal; and in a second sub-stage during which a second turn-on sub-signal provided by the second turn-on sub-signal terminal and a second clock sub-signal provided by the second clock sub-signal terminal are both at a first potential, driving, by the second drive sub-circuit, even-number rows of pixels from the $m^{th}$ row to the first row of pixels row by row in response to the second turn-on sub-signal and the second clock sub-signal.

3. The method according to claim 1, wherein the second sub-circuit group comprise: a third drive sub-circuit and a fourth drive sub-circuit; the second turn-on signal terminal comprises: a third turn-on sub-signal terminal and a fourth turn-on sub-signal terminal; the second clock signal terminal comprises: a third clock sub-signal terminal and a fourth clock sub-signal terminal; and the second drive stage comprises:

a third sub-stage during which a third turn-on sub-signal provided by the third turn-on sub-signal terminal and a third clock sub-signal provided by the third clock sub-signal terminal are both at a first potential, driving, by the third drive sub-circuit, odd-number rows of pixels of the $(m+1)^{th}$ row to the $N^{th}$ row of pixels row by row in response to the third turn-on sub-signal and the third clock sub-signal; and in a fourth sub-stage during which a fourth turn-on sub-signal provided by the fourth turn-on sub-signal terminal and a fourth clock sub-signal provided by the fourth clock sub-signal terminal are both at a first potential, driving, by the fourth drive sub-circuit, even-number rows of pixels from the $(m+1)^{th}$ row to the $N^{th}$ row of pixels row by row in response to the fourth turn-on sub-signal and the fourth clock sub-signal.

4. The method according to claim 1, wherein prior to the first drive stage and the second drive stage, the method further comprises:

in a dummy output stage during which the first turn-on signal provided by the first turn-on signal terminal and the second turn-on signal provided by the second turn-on signal terminal are both at a second potential, the first clock signal terminal provides a first clock signal, and the second clock signal terminal provides a second clock signal.

5. The method according to claim 1, wherein the first sub-circuit group comprises: a first drive sub-circuit and a second drive sub-circuit; the first turn-on signal terminal comprises: a first turn-on sub-signal terminal and a second turn-on sub-signal terminal; and the first clock signal terminal comprises: a first clock sub-signal terminal and a second clock sub-signal terminal;

wherein the first drive sub-circuit is connected to the first turn-on sub-signal terminal, the first clock sub-signal terminal and odd-number rows of pixels from the $m^{th}$ row to the first row of pixels, respectively, and configured to drive the odd-number rows of pixels from the $m^{th}$ row to the first row of pixels row by row in response to a first turn-on sub-signal provided by the first turn-on sub-signal terminal and a first clock sub-signal provided by the first clock sub-signal terminal; and the second drive sub-circuit is connected to the second turn-on sub-signal terminal, the second clock sub-signal terminal, and even-number rows of pixels from the $m^{th}$ row to the first row of pixels, respectively, and configured to drive the even-number rows of pixels from the $m^{th}$ row to the first row of pixels row by row in response to a second turn-on sub-signal provided by the second turn-on sub-signal terminal and a second clock sub-signal provided by the second clock sub-signal terminal.

6. The method according to claim 5, wherein the first drive sub-circuit and the second drive sub-circuit both comprise at least two cascaded shift register units, and each shift register unit is connected to one row of pixels; and the first sub-circuit group further comprises: two first dummy sub-circuits and two second dummy sub-circuits;

wherein each of the first dummy sub-circuits is connected to the first turn-on sub-signal terminal and the first clock sub-signal terminal respectively, one of the first dummy sub-circuits is connected to an input terminal of a first stage of shift register unit in the first drive sub-circuit and configured to transmit the first turn-on sub-signal to the first stage of shift register unit in the first drive sub-circuit under the drive of the first turn-on sub-signal and the first clock sub-signal; and the other one of the first dummy sub-circuits is connected to an input terminal of a last stage of shift register unit in the first drive sub-circuit and configured to transmit the first turn-on sub-signal to the last stage of shift register unit in the first drive sub-circuit under the drive of the first turn-on sub-signal and the first clock sub-signal; and each of the second dummy sub-circuits is connected to the second turn-on sub-signal terminal and the second clock sub-signal terminal respectively, one of the second dummy sub-circuits is connected to an input terminal of a first stage of shift register unit in the second drive sub-circuit and configured to transmit the second turn-on sub-signal to the first stage of shift register unit in the second drive sub-circuit under the drive of the second turn-on sub-signal and the second clock sub-signal; and the other one of the second dummy sub-circuits is connected to an input terminal of a last stage of shift register unit in the second drive sub-circuit and configured to transmit the second turn-on sub-signal to the last stage of shift register unit in the second drive sub-circuit under the drive of the second turn-on sub-signal and the second clock sub-signal.

7. The method according to claim 5, wherein the second sub-circuit group comprise: a third drive sub-circuit and a fourth drive sub-circuit;

wherein the third drive sub-circuit is connected to a third turn-on sub-signal terminal, a third clock sub-signal terminal, and odd-number rows of pixels from the $(m+1)^{th}$ row to the $N^{th}$ row of pixels of the N rows of pixels, respectively, and configured to drive the odd-number rows of pixels from the $(m+1)^{th}$ row to the $N^{th}$ row of pixels row by row in response to a third turn-on sub-signal provided by the third turn-on sub-signal terminal and a third clock sub-signal provided by the third clock sub-signal terminal; and the fourth drive sub-circuit is connected to a fourth turn-on sub-signal terminal, a fourth clock sub-signal terminal and even-number rows of pixels from the $(m+1)^{th}$ row to the $N^{th}$ row of pixels, respectively, and configured to drive the even-number rows of pixels from the $(m+1)^{th}$ row to the $N^{th}$ row of pixels row by row in response to a fourth turn-on sub-signal provided by the fourth turn-on sub-signal terminal and a fourth clock sub-signal provided by the fourth clock sub-signal terminal.

8. The method according to claim 7, wherein each drive sub-circuit comprises at least two cascaded shift register units, and each shift register unit is connected to one row of pixels; and the gate drive circuit further comprises: two first dummy sub-circuits, two second dummy sub-circuits, two third dummy sub-circuits, and two fourth dummy sub-circuits;

wherein each of the first dummy sub-circuits is connected to the first turn-on sub-signal terminal and the first clock sub-signal terminal respectively, one of the first dummy sub-circuits is connected to an input terminal of a first stage of shift register unit in the first drive sub-circuit and configured to transmit the first turn-on sub-signal to the first stage of shift register unit in the first drive sub-circuit under the drive of the first turn-on sub-signal and the first clock sub-signal; and the other one of the first dummy sub-circuits is connected to an input terminal of a last stage of shift register unit in the first drive sub-circuit and configured to transmit the first turn-on sub-signal to the last stage of shift register unit in the first drive sub-circuit under the drive of the first turn-on sub-signal and the first clock sub-signal;

each of the second dummy sub-circuits is connected to the second turn-on sub-signal terminal and the second clock sub-signal terminal respectively, one of the second dummy sub-circuits is connected to an input terminal of a first stage of shift register unit in the second drive sub-circuit and configured to transmit the second turn-on sub-signal to the first stage of shift register unit in the second drive sub-circuit under the drive of the second turn-on sub-signal and the second clock sub-signal; and the other one of the second dummy sub-circuits is connected to an input terminal of a last stage of shift register unit in the second drive sub-circuit and configured to transmit the second turn-on sub-signal to the last stage of shift register unit in the second drive sub-circuit under the drive of the second turn-on sub-signal and the second clock sub-signal;

each of the third dummy sub-circuits is connected to the third turn-on sub-signal terminal and the third clock sub-signal terminal respectively, one of the third dummy sub-circuits is connected to an input terminal of a first stage of shift register unit in the third drive sub-circuit and configured to transmit the third turn-on sub-signal to the first stage of shift register unit in the third drive sub-circuit under the drive of the third turn-on sub-signal and the third clock sub-signal; and the other one of the third dummy sub-circuits is connected to an input terminal of a last stage of shift register unit in the third drive sub-circuit and configured to transmit the third turn-on sub-signal to the last stage of shift register unit in the third drive sub-circuit under the drive of the third turn-on sub-signal and the third clock sub-signal; and each of the fourth dummy sub-circuits is connected to the fourth turn-on sub-signal terminal and the fourth clock sub-signal terminal respectively, one of the fourth dummy sub-circuits is connected to an input terminal of a first stage of shift register unit in the fourth drive sub-circuit and configured to transmit the fourth turn-on sub-signal to the first stage of shift register unit in the fourth drive sub-circuit under the drive of the fourth turn-on sub-signal and the fourth clock sub-signal; and the other one of the fourth dummy sub-circuits is connected to an input terminal of a last stage of shift register unit in the fourth drive sub-circuit and configured to transmit the fourth turn-on sub-signal to the last stage of shift register unit in the fourth drive sub-circuit under the drive of the fourth turn-on sub-signal and the fourth clock sub-signal.

9. The method according to claim 8, wherein N is an even number, and m satisfies: m=N/2;

the first drive sub-circuit and the third drive sub-circuit are on the same side of the display panel, and the second drive sub-circuit and the fourth drive sub-circuit are on the same side of the display panel, and both an extending direction of a side edge of the side which the first drive sub-circuit and the third drive sub-circuit are on and an extending direction of a side edge of the side which the second drive sub-circuit and the fourth drive sub-circuit are on are perpendicular to an extending direction of a gate line in the display panel.

10. The method according to claim 1, wherein the second sub-circuit group further comprises: a third drive sub-circuit and a fourth drive sub-circuit; the second turn-on signal terminal comprises: a third turn-on sub-signal terminal and a fourth turn-on sub-signal terminal; and the second clock signal terminal comprises: a third clock sub-signal terminal and a fourth clock sub-signal terminal;

wherein the third drive sub-circuit is connected to the third turn-on sub-signal terminal, the third clock sub-signal terminal, and odd-number rows of pixels from the $(m+1)^{th}$ row to the $N^{th}$ row of pixels, respectively, and configured to drive the odd-number rows of pixels from the $(m+1)^{th}$ row to the $N^{th}$ row of pixels row by row in response to a third turn-on sub-signal provided by the third turn-on sub-signal terminal and a third clock sub-signal provided by the third clock sub-signal terminal; and the fourth drive sub-circuit is connected to the fourth turn-on sub-signal terminal, the fourth clock sub-signal terminal and even-number rows of pixels from the $(m+1)^{th}$ row to the $N^{th}$ row of pixels, respectively, and configured to drive the even-number rows of pixels from the $(m+1)^{th}$ row to the $N^{th}$ row of pixels row by row in response to a fourth turn-on sub-signal provided by the fourth turn-on sub-signal terminal and a fourth clock sub-signal provided by the fourth clock sub-signal terminal.

11. The method according to claim 10, wherein the third drive sub-circuit and the fourth drive sub-circuit both comprise at least two cascaded shift register units, and each shift register unit is connected to one row of pixels; and the second sub-circuit group further comprises: two third dummy sub-circuits and two fourth dummy sub-circuits;

wherein each of the third dummy sub-circuits is connected to the third turn-on sub-signal terminal and the third clock sub-signal terminal respectively, one of the third dummy sub-circuits is connected to an input terminal of a first stage of shift register unit in the third drive sub-circuit and configured to transmit the third turn-on sub-signal to the first stage of shift register unit in the third drive sub-circuit under the drive of the third turn-on sub-signal and the third clock sub-signal; and the other one of the third dummy sub-circuits is connected to an input terminal of a last stage of shift register unit in the third drive sub-circuit and configured to transmit the third turn-on sub-signal to the last stage of shift register unit in the third drive sub-circuit under the drive of the third turn-on sub-signal and the third clock sub-signal; and each of the fourth dummy sub-circuits is connected to the fourth turn-on sub-signal terminal and the fourth clock sub-signal terminal respectively, one of the fourth dummy sub-circuits is connected to an input terminal of a first stage of shift register unit in the fourth drive sub-circuit and configured to transmit the fourth turn-on sub-signal to the first stage of shift register unit in the fourth drive sub-circuit under the drive of the fourth turn-on sub-signal and the fourth clock sub-signal; and the other one of the fourth dummy sub-circuits is connected to an input terminal of a last stage of shift register unit in the fourth drive sub-circuit and configured to transmit the fourth turn-on sub-signal to the last stage of shift register unit in the fourth drive sub-circuit under the drive of the fourth turn-on sub-signal and the fourth clock sub-signal.

12. The method according to claim 10, wherein the first sub-circuit group comprises a first drive sub-circuit and a second drive sub-circuit;

wherein the first drive sub-circuit and the second drive sub-circuit are disposed oppositely on the two sides of the display panel, and the third drive sub-circuit and the fourth drive sub-circuit are disposed oppositely on the two sides of the display panel;

wherein the first drive sub-circuit and the third drive sub-circuit are on the same side of the display panel, and the second drive sub-circuit and the fourth drive sub-circuit are on the same side of the display panel, and both an extending direction of a side edge of the side which the first drive sub-circuit and the third drive sub-circuit are on and an extending direction of a side edge of the side which the second drive sub-circuit and the fourth drive sub-circuit are on are perpendicular to an extending direction of a gate line in the display panel.

13. The method according to claim 1, wherein m satisfies: $m=N/2$ when N is an even number.

14. The method according to claim 1, wherein when N is an odd number, m satisfies one of following conditions:

$m=\lceil N/2 \rceil$;

$m=\lfloor N/2 \rfloor$; wherein $\lceil\ \rceil$ represents rounding up to the nearest integer and $\lfloor\ \rfloor$ represents rounding down to the nearest integer.

* * * * *